US008847488B2

(12) United States Patent
Doughty

(10) Patent No.: US 8,847,488 B2
(45) Date of Patent: Sep. 30, 2014

(54) FILL COMBINATION AND METHOD FOR HIGH INTENSITY LAMPS

(75) Inventor: Douglas A. Doughty, Gilroy, CA (US)

(73) Assignee: Topanga USA, Inc., Canoga Park, CA (US)

( * ) Notice: Subject to any disclaimer, the term of this patent is extended or adjusted under 35 U.S.C. 154(b) by 209 days.

(21) Appl. No.: 13/004,880

(22) Filed: Jan. 12, 2011

(65) Prior Publication Data

US 2012/0176029 A1 Jul. 12, 2012

(51) Int. Cl.

| | |
|---|---|
| ***H01J 61/12*** | (2006.01) |
| ***H01J 65/04*** | (2006.01) |
| ***H01J 61/54*** | (2006.01) |
| ***H01J 61/20*** | (2006.01) |

(52) U.S. Cl.

CPC ..... *H01J 65/042* (2013.01); *H01J 61/548* (2013.01); *H01J 61/20* (2013.01); *H01J 61/125* (2013.01)

USPC ..... 313/572; 313/641; 315/248

(58) Field of Classification Search

None

See application file for complete search history.

(56) References Cited

U.S. PATENT DOCUMENTS

2009/0322240 A1* 12/2009 Espiau et al. ..... 315/248
2011/0043123 A1* 2/2011 Gilliard et al. ..... 315/248

* cited by examiner

*Primary Examiner* — Britt D Hanley

(74) *Attorney, Agent, or Firm* — Kilpatrick Townsend and Stockton LLP

(57) ABSTRACT

A plasma lamp apparatus. The apparatus can have a bulb coupled to at least the first end of a support member that is provided within a housing having an interior and exterior region. The housing can also have a first coupling member disposed within the housing, and a gap can be provided between the first coupling member and the support member. Additionally an rf source can be coupled to the support member. A fill material, which can include at least a first volume of a rare gas, a first amount of a first metal halide, a second amount of a second metal halide, and a third amount of mercury, can be spatially disposed within the bulb.

31 Claims, 29 Drawing Sheets

FILL COMBINATION AND METHOD FOR HIGH INTENSITY LAMPS

CROSS-REFERENCES TO RELATED APPLICATIONS

The present application incorporates by reference, for all purposes, the following pending patent application: U.S. patent application Ser. No. 12/484,933, filed Jun. 15, 2009.

BACKGROUND OF THE INVENTION

The present invention relates generally to lighting techniques. In particular, the present invention provides a method and device using a plasma lighting device having a novel combination of fill materials to achieve a desired illumination having a high intensity. Merely by way of example, such plasma lamps can be applied to applications such as stadiums, security, parking lots, military and defense, streets, large and small buildings, vehicle headlamps, aircraft landing, bridges, warehouses, uv water treatment, agriculture, architectural lighting, stage lighting, medical illumination, microscopes, projectors and displays, any combination of these, and the like.

From the early days, human beings have used a variety of techniques for lighting. Early humans relied on fire to light caves during hours of darkness. Fire often consumed wood for fuel. Wood fuel was soon replaced by candles, which were derived from oils and fats. Candles were then replaced, at least in part by lamps. Certain lamps were fueled by oil or other sources of energy. Gas lamps were popular and still remain important for outdoor activities such as camping. In the late 1800, Thomas Edison, who is the greatest inventor of all time, conceived the incandescent lamp, which uses a tungsten filament within a bulb, coupled to a pair of electrodes. Many conventional buildings and homes still use the incandescent lamp, commonly called the Edison bulb. Although highly successful, the Edison bulb consumed much energy and was generally inefficient.

Fluorescent lighting replaced incandescent lamps for certain applications. Fluorescent lamps generally consist of a tube containing a gaseous material, which is coupled to a pair of electrodes. The electrodes are coupled to a ballast, which helps ignite and stabilize the discharge created in the contained gas. Conventional building structures often use fluorescent lighting, rather than the incandescent counterpart. Fluorescent lighting is much more efficient than incandescent lighting, but often has a higher initial cost.

Shuji Nakamura pioneered the efficient blue light emitting diode, which is a solid state lamp. The blue light emitting diode forms a basis for the white solid state light, which is often a blue light emitting diode within a bulb coated with a yellow phosphor material. Blue light excites the phosphor material to emit white lighting. The blue light emitting diode has revolutionized the lighting industry to replace traditional lighting for homes, buildings, and other structures.

Another form of lighting is commonly called the electrode-less lamp, which can be used to discharge light for high intensity applications. Frederick M. Espiau was one of the pioneers that developed an improved electrode-less lamp. Such electrode-less lamp relied upon a solid ceramic resonator structure, which was coupled to a fill enclosed in a bulb. The bulb was coupled to the resonator structure via rf feeds, which transferred power to the fill to cause it to discharge high intensity lighting. Although somewhat successful, the electrode-less lamp still had many limitations. As an example, electrode-less lamps have not been successfully deployed.

Additionally, electrode-less lamps are generally difficult to disassemble and assembly leading to inefficient use of such lamps. These and other limitations may be described throughout the present specification and more particularly below.

From the above, it is seen that improved techniques for lighting are highly desired.

BRIEF SUMMARY OF THE INVENTION

The present invention relates generally to lighting techniques. In particular, the present invention provides a method and device using a plasma lighting device having a novel combination of fill materials to achieve a desired illumination having a high intensity. Merely by way of example, such plasma lamps can be applied to applications such as stadiums, security, parking lots, military and defense, streets, large and small buildings, vehicle headlamps, aircraft landing, bridges, warehouses, uv water treatment, agriculture, architectural lighting, stage lighting, medical illumination, microscopes, projectors and displays, any combination of these, and the like.

In a specific embodiment, the present invention provides a plasma lamp apparatus. The apparatus can have a housing having an interior region, which can have a spatial volume, and an exterior region. The apparatus can also have a support member, with a first and second end, that is provided within the housing. An rf source can be coupled to the support member, and a bulb a can be coupled to the first end of the support member. The bulb can have a volume ranging from about 0.2 cubic centimeters to about 0.5 cubic centimeters. A coupling member can be disposed within the house with a gap between the coupling member and the support member. A fill material including thulium bromide, indium bromide, and mercury, can be disposed within the bulb. The fill material can be configured to discharge substantially white light along a visible range representative of a black body source and providing at least 120 lumens per watt. Of course, there can be other variations, modifications, and alternatives.

In various embodiments, the apparatus can have a bulb coupled to at least the first end of a support member that is provided within a housing having an interior and exterior region. The housing can also have a first coupling member disposed within the housing, and a gap can be provided between the first coupling member and the support member. Additionally an rf source can be coupled to the support member. A fill material, which can include at least a first volume of a rare gas, a first amount of a first metal halide, a second amount of a second metal halide, and a third amount of mercury, can be spatially disposed within the bulb. Those skilled in the art will recognize other variations, modifications, and alternatives.

Benefits are achieved over pre-existing techniques using the present invention. In a specific embodiment, the present invention provides a method and device having configurations of input, output, and feedback coupling elements that provide for electromagnetic coupling to the bulb whose power transfer and frequency resonance characteristics that are largely independent of the conventional dielectric resonator, but can also be dependent upon conventional designs. In a preferred embodiment, the present invention provides a method and configurations with an arrangement that provides for improved manufacturability as well as design flexibility. Other embodiments may include integrated assemblies of the output coupling element and bulb that function in a complementary manner with the present coupling element configurations and related methods for street lighting applications. Still further, the present method and device provide for improved heat transfer characteristics, as well as further simplifying manufacturing and/or retrofitting of existing and new street lighting, such as lamps, and the like. In a specific embodiment, the present method and resulting structure are relatively simple and cost effective to manufacture for commercial applications. In a specific embodiment, the present invention includes a helical resonator structure, which increases inductance and therefore reduces the resonating frequency of a device. In a preferred embodiment, the present method and device provides a plasma lighting device having a novel combination of fill materials to achieve a desired illumination having a high intensity. Depending upon the embodiment, one or more of these benefits may be achieved. These and other benefits may be described throughout the present specification and more particularly below.

The present invention achieves these benefits and others in the context of known process technology. However, a further understanding of the nature and advantages of the present invention may be realized by reference to the latter portions of the specification and attached drawings.

BRIEF DESCRIPTION OF THE DRAWINGS

A more complete understanding of the present invention and its advantages will be gained from a consideration of the following description of preferred embodiments, read in conjunction with the accompanying drawings provided herein. In the figures and description, numerals indicate various features of the invention, and like numerals referring to like features throughout both the drawings and the description.

DETAILED DESCRIPTION OF THE INVENTION

Figure 1A:
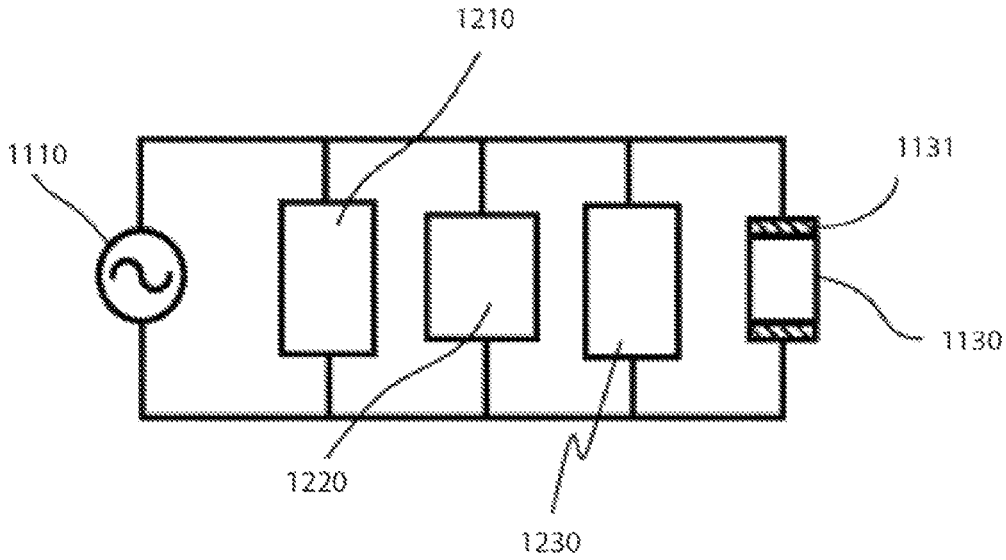
FIG. 1A is a generalized schematic of a gas-fill vessel being driven by an RF source, and capacitively coupled to the source; to optimize lamp efficiency and light output, a plurality of impedance matching networks are present between the RF source and the resonator and between the resonator and gas-fill vessel according to an embodiment of the present invention.

According to the present invention, techniques for lighting are provided. In particular, the present invention provides a method and device using a plasma lighting device having a arc tube configured for an electrode-less plasma lamp using an radio frequency source. Merely by way of example, such plasma lamps can be applied to applications such as stadiums, security, parking lots, military and defense, streets, large and small buildings, vehicle headlamps, aircraft landing, bridges, warehouses, uv water treatment, agriculture, architectural lighting, stage lighting, medical illumination, microscopes, projectors and displays, any combination of these, and the like.

The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the Claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object. Additionally, the terms "first" and "second" or other like descriptors do not necessarily imply an order, but should be interpreted using ordinary meaning.

As background for the reader, we would like to describe conventional lamps and their limitations that we discovered. Electrodeless plasma lamps driven by microwave sources have been proposed. Conventional configurations include a gas filled vessel (bulb) containing Argon and a light emitter such as Sulfur or Cesium Bromide (see for example, U.S. Pat. No. 6,476,557B1 and FIG. 1 herein). The bulb is positioned inside an air resonator/waveguide with the microwave energy provided by a source such as a magnetron and introduced into the resonator/waveguide to heat and ionize the Argon gas and vaporize the Sulfur to emit light. To use RF sources that are efficient and low-cost it is desirable to design the resonator/waveguide to operate at frequencies below approximately 2.5 GHz and preferably below 1 GHz. A conventional air resonator/waveguide operating in the fundamental resonant mode of the resonator at 1 GHz has at least one dimension that is approximately 15 cm long since this length is about half the free-space wavelength (lambda/2) of the resonant frequency of the resonator.

This results in limitations that were discovered. Such limitations include a resonator/waveguide size that is too large for most commercial lighting applications since the resonator/waveguide will not fit within typical lighting fixtures (luminaires). In addition since the bulb was placed inside the air/resonator cavity, the arc of the bulb is not accessible for use in the design of reflectors for various types of luminaires used in commercial and industrial lighting applications.

In the configuration proposed in U.S. Pat. No. 6,737,809B2, Espiau, el al., the air inside the resonator is replaced with alumina resulting in reducing the size of the resonator/waveguide since the free-space wavelength (fundamental mode guided wavelength for this resonator/ waveguide) is now reduced approximately by the square-root of the effective dielectric constant of the resonator body. See also FIG. 2. This approach has some advantages over the air resonator in U.S. Pat. No. 6,476,557B1 by reducing the size of the resonator but it has its own drawbacks. Such drawbacks may include higher manufacturing costs, losses associated with the dielectric material, and blockage of light from the bulb by the dielectric material. In this approach, the arc of the bulb is not accessible either limiting its use in various types of luminaires used in commercial and industrial lighting applications.

FIG. 1A illustrates a general schematic for efficient energy transfer from RF source 1110 to gas fill vessel 1130. This diagram is merely an example, which should not unduly limit the scope of the claims herein. One of ordinary skill in the art would recognize other variations, modifications, and alternatives. Energy from the RF source is directed to an impedance matching network 1210 that enables the effective transfer of energy from RF source to resonating structure 1220. An example of such impedance matching network is an E-field or H-field coupling element, but can be others. Another impedance matching network 1230, in turn, enables efficient energy transfer from resonator to gas fill vessel 1130 according to an embodiment of the present invention. An example of the impedance matching network is an E-field or H-field coupling element. Of course, there can be other variations, modifications, and alternatives.

In a specific embodiment, the gas filled vessel is made of a suitable material such as quartz or other transparent or translucent material such as polycrystalline alumina. The gas filled vessel is filled with an inert gas such as Argon and a light emitter such as Mercury, Sodium, Sulfur or a metal halide salt such as Indium Bromide, Scandium Bromide, or Cesium Iodide (or it can simultaneously contain multiple light emitting species), such as Mercury, Thulium Bromide, and Indium Bromide according to a specific embodiment. The gas filled vessel can also includes a metal halide, or other metal pieces that will discharge electromagnetic radiation according to a specific embodiment. Of course, there can be other variations, modifications, and alternatives.

In a specific embodiment, a capacitive coupling structure 1131 is used to deliver RF energy to the gas fill within the bulb 1130. As is well known, a capacitive coupler typically comprises two electrodes of finite extent enclosing a volume and couples energy primarily using at least Electric fields (E-fields). As can be appreciated by one of ordinary skill in the art, the impedance matching networks 1210 and 1230 and the resonating structure 1220, as depicted in schematic form here, can be interpreted as equivalent-circuit models of the distributed electromagnetic coupling between the RF source and the capacitive coupling structure. The use of impedance matching networks also allows the source to have an impedance other than 50 ohm; this may provide an advantage with respect to RF source performance in the form of reduced heating or power consumption from the RF source. Lowering power consumption and losses from the RF source would enable a greater efficiency for the lamp as a whole. As can also be appreciated by one of ordinary skill in the art, the impedance matching networks 1210 and 1230 are not necessarily identical.

Figure 1B:
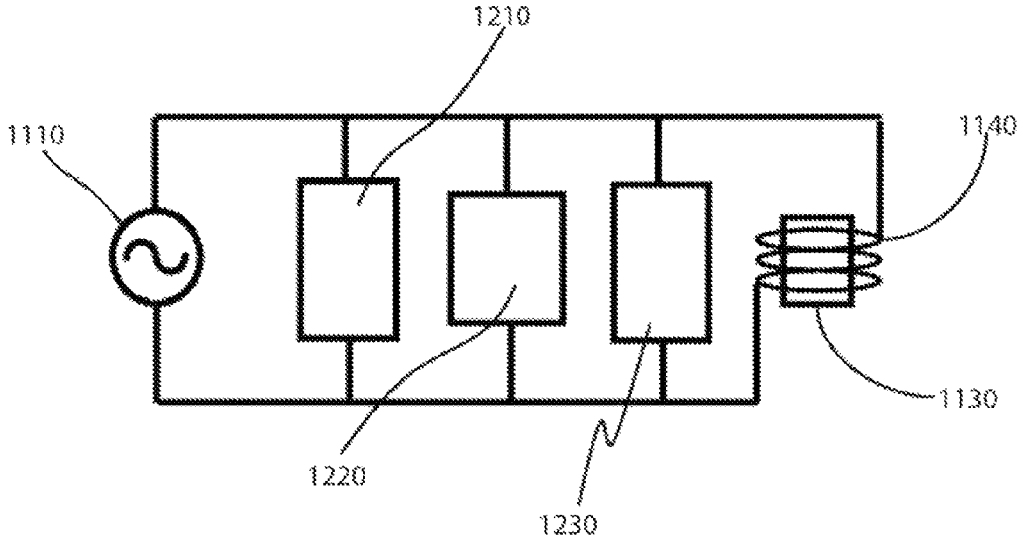
FIG. 1B is a generalized schematic of a gas-fill vessel being driven by an RF source, and inductively coupled to the source; to optimize lamp efficiency and light output, a plurality of impedance matching networks are present between the RF source and the resonator and between the resonator and gas-fill vessel according to an embodiment of the present invention.

FIG. 1B illustrates a general schematic for efficient energy transfer from RF source 1110 to gas fill vessel 1130. This diagram is merely an example, which should not unduly limit the scope of the claims herein. One of ordinary skill in the art would recognize other variations, modifications, and alternatives. Energy from the RF source is directed to an impedance matching network 1210 that enables the effective transfer of energy from RF source to resonating structure 1220. Another impedance matching network 1230, in turn, enables efficient energy transfer from resonator to gas fill vessel 1130. An inductive coupling structure 1140 is used to deliver RF energy to the gas fill within the bulb 1130. As is well known, an inductive coupler typically comprises a wire or a coil-like wire of finite extent and couples energy primarily using magnetic fields (H-fields). As can be appreciated by one of ordinary skill in the art, the impedance matching networks 1210 and 1230 and the resonating structure 1220, as depicted in schematic form here, can be interpreted as equivalent-circuit models of the distributed electromagnetic coupling between the RF source and the inductive coupling structure. The use of impedance matching networks also allows the source to have an impedance other than 50 ohm; this may provide an advantage with respect to RF source performance in the form of reduced heating or power consumption from the RF source. Lowering power consumption and losses from the RF source would enable a greater efficiency for the lamp as a whole. As can also be appreciated by one of ordinary skill in the art, the impedance matching networks 1210 and 1230 are not necessarily identical.

Figure 2A:
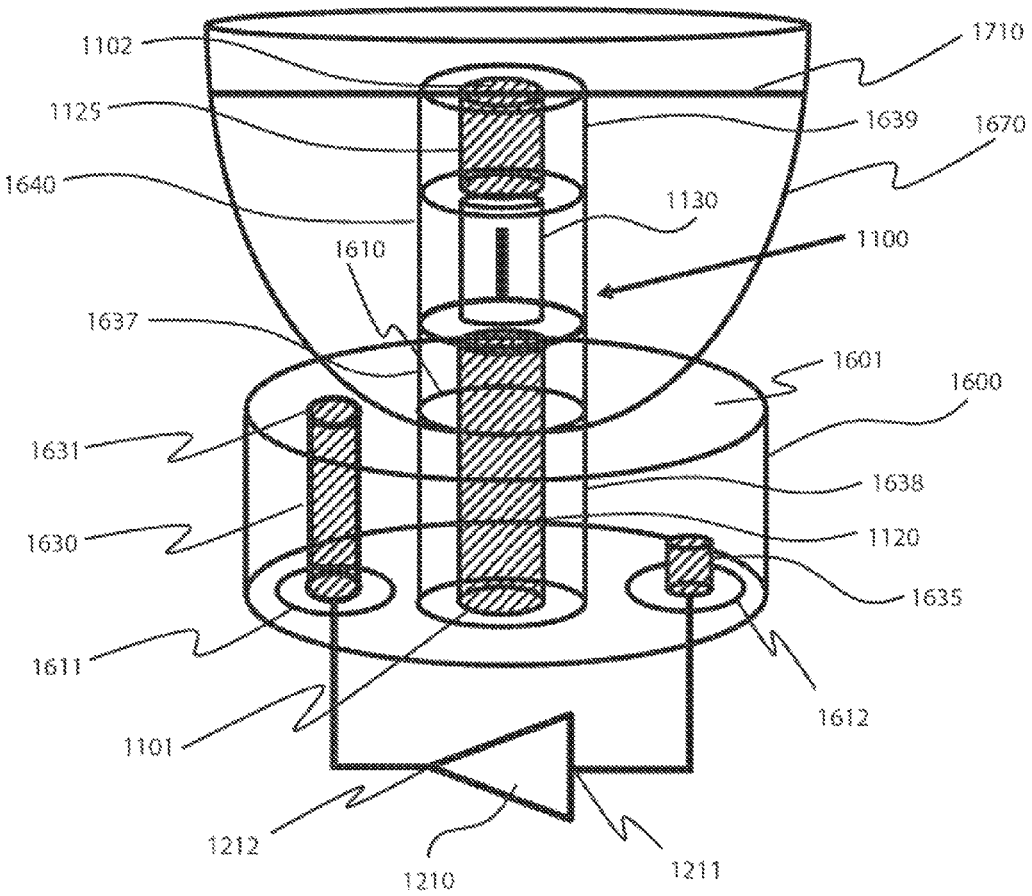
FIG. 2A is a simplified perspective view of an external resonator electrodeless lamp, comprising a lamp body, input and feedback coupling elements, an integrated bulb/output coupling element assembly, an external reflector, and an external RF amplifier according to an embodiment of the present invention.

FIG. 2A is a perspective view of an electrodeless lamp, employing a lamp body 1600, whose outer surface 1601 is electrically conductive and is connected to ground. This diagram is merely an example, which should not unduly limit the scope of the claims herein. One of ordinary skill in the art would recognize other variations, modifications, and alternatives. A cylindrical lamp body is depicted, but rectangular or other shapes may be used. This conductivity may be achieved through the application of a conductive veneer, or through the choice of a conductive material. An example embodiment of conductive veneer is silver paint or alternatively the lamp body can be made from sheet of electrically conductive material such as aluminum. An integrated bulb/output coupling-element assembly 1100 is closely received by the lamp body 1600 through opening 1610. The bulb/output coupling-element assembly 1100 contains the bulb 1130, which is a gas-fill vessel that ultimately produces the luminous output.

One aspect of the invention is that the bottom of the assembly 1100, output coupling-element 1120, is grounded to the body 1600 and its conductive surface 1601 at plane 1101. The luminous output from the bulb is collected and directed by an external reflector 1670, which is either electrically conductive or if it is made from a dielectric material has an electrically conductive backing, and which is attached to and in electrical contact with the body 1600. Another aspect of the invention is that the top of the assembly 1100, top coupling-element 1125, is grounded to the body 1600 at plane 1102 via the ground strap 1710 and the reflector 1670. Alternatively, the reflector 1670 may not exist, and the ground strap makes direct electrical contact with the body 1600. Reflector 1670 is depicted as parabolic in shape with bulb 1130 positioned near its focus. Those of ordinary skill in the art will recognize that a wide variety of possible reflector shapes can be designed to satisfy beam-direction requirements. In a specific embodiment, the shapes can be conical, convex, concave, trapezoidal, pyramidal, or any combination of these, and the like. The shorter feedback E-field coupling-element 1635 couples a small amount of RF energy from the bulb/output coupling-element assembly 1100 and provides feedback to the RF amplifier input 1211 of RF amplifier 1210. Feedback coupling-element 1635 is closely received by the lamp body 1600 through opening 1612, and as such is not in direct DC electrical contact with the conductive surface 1601 of the lamp body. The input coupling-element 1630 is conductively connected with RF amplifier output 1212. Input coupling-element 1630 is closely received by the lamp body 1600 through opening 1611, and as such is not in direct DC electrical contact with the conductive surface 1601 of the lamp body. However, it is another key aspect of the invention that the top of the input coupling-element is grounded to the body 1600 and its conductive surface 1601 at plane 1631.

RF power is primarily inductively coupled strongly from the input coupling-element 1630 to the bulb/output coupling-element assembly 1100 through physical proximity, their relative lengths, and the relative arrangement of their ground planes. Surface 1637 of bulb/output coupling-element assembly is covered with an electrically conductive veneer or an electrically conductive material and is connected to the body 1600 and its conductive surface 1601. The other surfaces of the bulb/output coupling-element assembly including surfaces 1638, 1639, and 1640 are not covered with a conductive layer. In addition surface 1640 is optically transparent or translucent. The coupling between input coupling-element 1630 and output coupling-element 1120 and lamp assembly 1100 is found through electromagnetic simulation, and through direct measurement, to be highly frequency selective and to be primarily inductive. This frequency selectivity provides for a resonant oscillator in the circuit comprising the input coupling-element 1630, the bulb/output coupling-element assembly 1100, the feedback coupling-element 1635, and the amplifier 1210.

One of ordinary skill in the art will recognize that the resonant oscillator is the equivalent of the RF source 1110 depicted schematically in FIG. 1A and FIG. 1B. A significant advantage of the invention is that the resonant frequency is strongly dependent on the relative lengths of the input and output coupling-elements, and is moreover very weakly dependent on the dimensions or dielectric properties of the lamp body 1600 itself. This permits the use of a compact lamp body whose natural resonant frequency may be much higher than the actual frequency of operation. In one example embodiment, the bottom of the lamp body 1600 may consist of a hollow aluminum cylinder with a 1.5" diameter, and a height of 0.75". The fundamental resonant frequency of such an air cavity resonator is approximately 4 GHz but by using the design described above for the input coupling-element and the output coupling-element and by adjusting the length of the output coupling-element the overall resonant frequency of the lamp assembly can be reduced to 900 MHz or no greater than about 900 MHz in a specific embodiment. Another significant advantage of the invention is that the RF power coupled to the bulb 1130 is strongly dependent on the physical separation between the input coupling-element 1630 and the output coupling-element 1120 within the bulb/output coupling-element assembly 1100. This permits fine tuning, at assembly time, of the brightness output of a lamp which is comprised of components with relaxed dimensional tolerances. Another significant advantage of the invention is that the input coupling-element 1630 and the bulb/output coupling-element assembly 1100 are respectively grounded at planes 1631 and 1101, which are coincident with the outer surface of the body 1600. This eliminates the need to fine-tune their depth of insertion into the lamp body—as well as any sensitivity of the RF coupling between them to that depth—simplifying lamp manufacture, as well as improving consistency in lamp brightness yield.

Figure 2B:
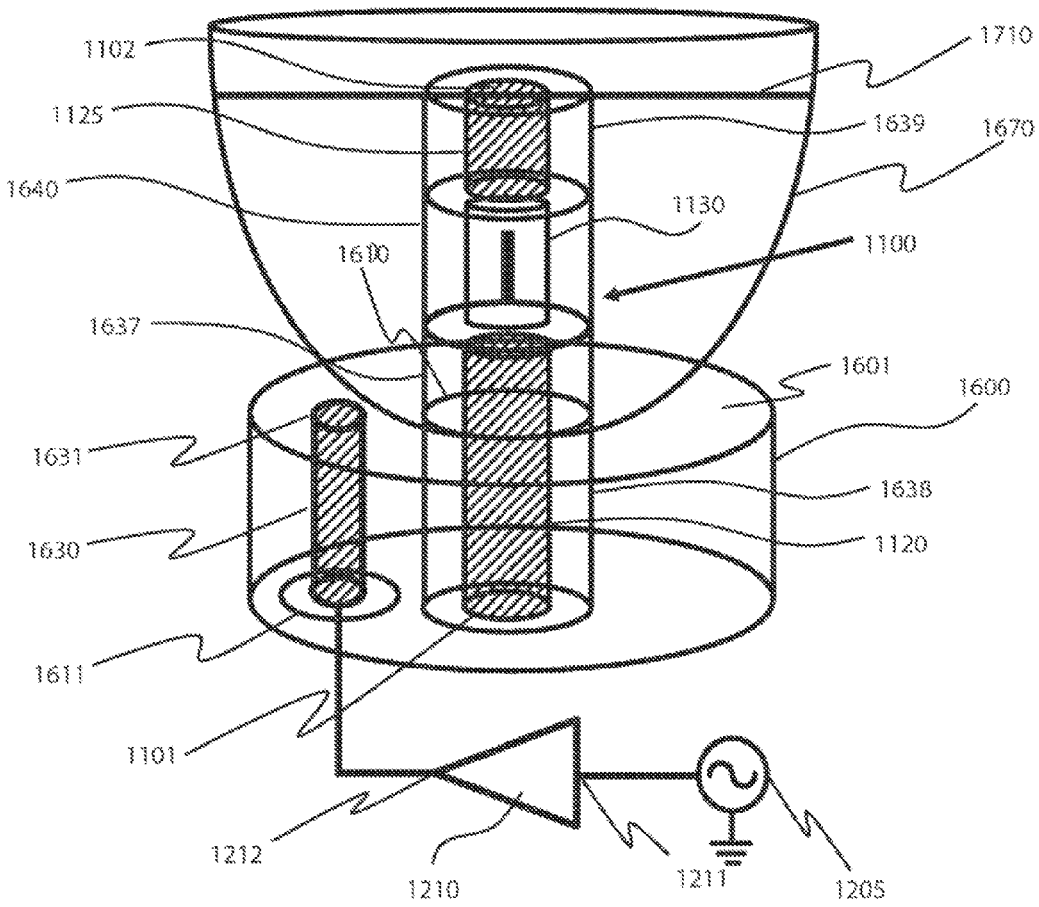
FIG. 2B is a simplified perspective view of an alternate external resonator electrodeless lamp, comprising a lamp body, input coupling element, an integrated bulb/output coupling element assembly, an external reflector, and an external RF source that may comprise an oscillator and an amplifier according to an embodiment of the present invention.

FIG. 2B is a perspective view of an electrodeless lamp that differs from that shown in FIG. 2A only in its RF source, which is not a distributed oscillator circuit, but rather a separate oscillator 1205 conductively connected with RF amplifier input 1211 of the RF amplifier 1210. RF amplifier output 1212 is conductively connected with input coupling-element 1630, which delivers RF power to the lamp/output coupling-element assembly 1100. The resonant characteristics of the coupling between the input coupling-element 1630 and the output coupling-element in the bulb/output coupling-element assembly 1100 are frequency-matched to the RF source to optimize RF power transfer. Of course, there can be other variations, modifications, and alternatives.

Figure 2C:
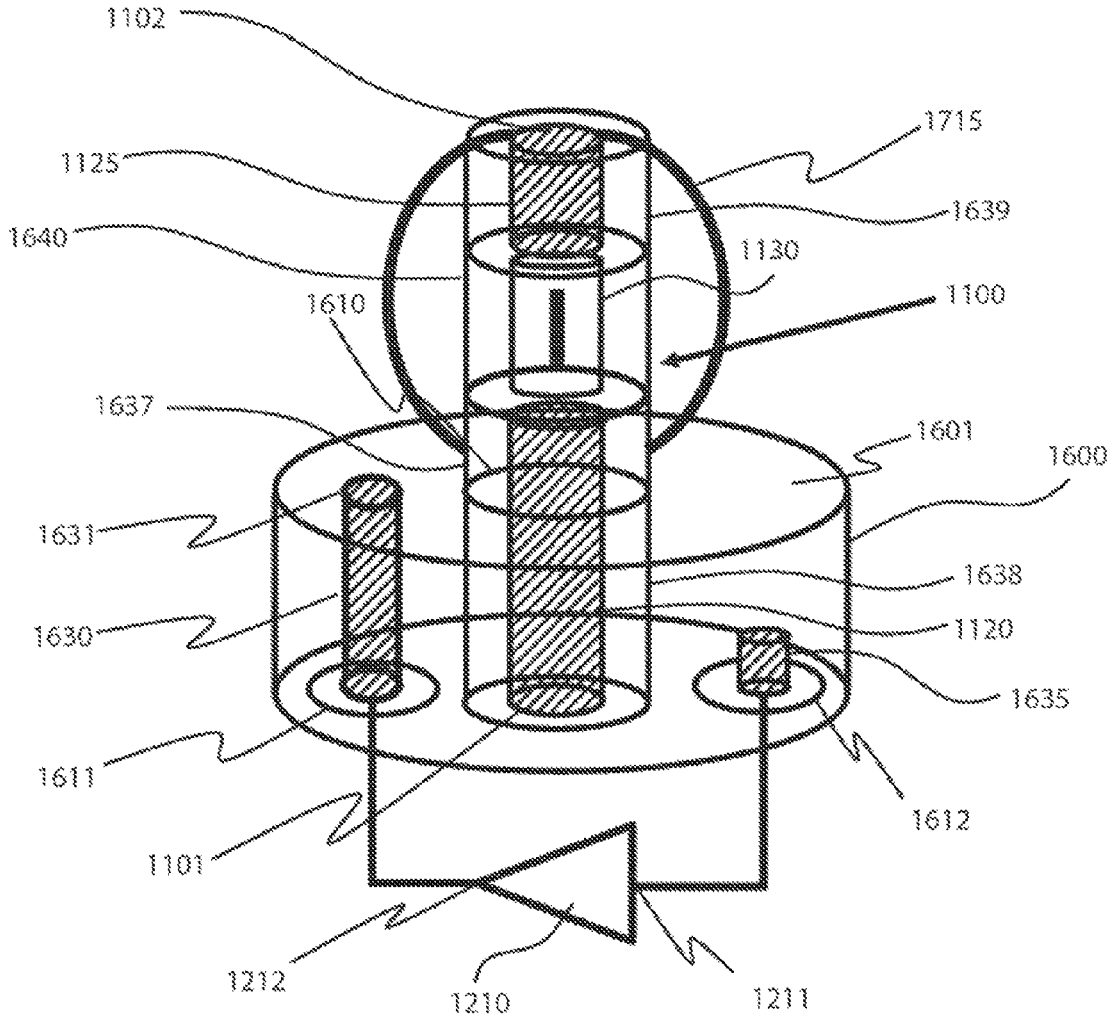
FIG. 2C is a simplified perspective view of an alternate external resonator electrodeless lamp, comprising a lamp body, input and feedback coupling elements, an integrated bulb/output coupling element assembly, and an external RF amplifier according to an embodiment of the present invention.
Figure 3A:
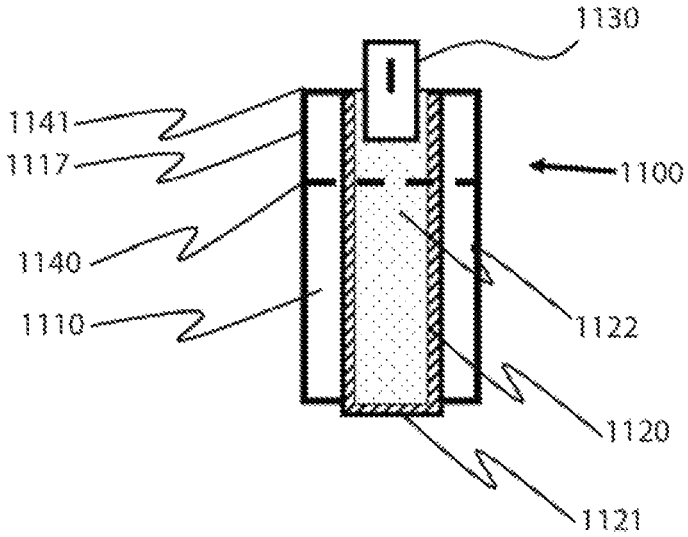
FIG. 3A is a simplified perspective view of an integrated bulb/output coupling element assembly comprising multiple sections including an output coupling element, a gas-fill vessel that is the bulb, and top coupling-element according to an embodiment of the present invention.

FIG. 2C is a perspective view of an electrodeless lamp that is similar to the electrodeless lamp shown in FIG. 2A except that it does not have a reflector 1670. The top coupling-element 1125 in the bulb assembly is directly connected to the lamp body 1600 using ground straps 1715. This diagram is merely an example, which should not unduly limit the scope of the claims herein. One of ordinary skill in the art would recognize other variations, modifications, and alternatives FIG. 3A is a perspective view of an integrated bulb/output coupling-element assembly 1100 which is the same as assembly 1100 depicted in FIGS. 2A, 2B, and 2C. This diagram is merely an example, which should not unduly limit the scope of the claims herein. One of ordinary skill in the art would recognize other variations, modifications, and alternatives. The assembly comprises a lower section 1110, a mid-section 1111, and upper section 1112. Alternatively, these sections may not be physically separate. The lower section 1110 is bored to closely receive output coupling-element 1120, which is a solid conductor. Coupling-element 1120 protrudes from the lower section 1110 at plane 1121. It is a key aspect of this invention that coupling-element 1120 makes ground contact at plane 1121 with the lamp body 1600 depicted in FIGS. 2A, 2B, and 2C. The mid-section 1111 is hollowed to closely receive the bulb 1130, which is the gas-fill vessel that ultimately produces the lamp's luminous output. The gas-fill vessel contains an inert gas such as Argon and a light emitter such as Mercury, Sodium, Sulfur or a metal halide salt such as Indium Bromide or Cesium Iodide (or it can simultaneously contain multiple light emitting species). Alternatively, the mid-section 1111 is hollowed, with the resulting cavity forming the volume of the bulb 1130, making the two an integrated unit. The mid-section 1111 can be attached to the lower section 1110 and upper section 1112 using high temperature adhesive. The upper section 1112 is bored to closely receive top electrode 1125, which is a solid conductor. Top electrode 1125 protrudes from upper section 1112 at plane 1126. It is a key aspect of this invention that the top coupling-element 1125 makes ground contact at plane 1126 with the lamp body 1600, as depicted in FIGS. 2A, 2B, and 2C. This is through the ground strap 1710 and the reflector body 1670 or ground strap 1715. Overall, RF energy is coupled capacitively, or inductively, or a combination of inductively and capacitively, by the output coupling-element 1120 and top coupling-element 1125 to the bulb 1130 which is made from quartz, translucent alumina, or other similar material, ionizing the inert gas and vaporizing the light emitter resulting in intense light 1115 emitted from the lamp.

Sections 1110, 1111, and 1112 can all be made from the same material or from different materials. Section 1111 has to be transparent to visible light and have a high melting point such as quartz or translucent alumina. Sections 1110 and 1112 can be made from transparent (quartz or translucent alumina) or opaque materials (alumina) but they have to have low loss at RF frequencies. In the case that the same material is used for all three sections the assembly can be made from a single piece of material such as a hollow tube of quartz or translucent alumina. The upper section 1112 may be coated with a conductive veneer 1116 whose purpose is to shield electromagnetic radiation from the top-electrode 1125. The lower section 1110 may be partially coated with a conductive veneer 1117 whose purpose is to shield electromagnetic radiation from the output coupling-element 1120. The partial coating would extend to the portion of the lower section 1110 that protrudes from the lamp body 1600, as depicted in FIGS. 2A, 2B, and 2C and does not overlap with input coupling-element 1630. The plane dividing that portion that protrudes from the lamp body from that portion that does not being depicted schematically by dashed line 1140. An example embodiment of conductive veneers 1116 and 1117 is silver paint. The outer surface of the mid section 1111 is not coated.

Figure 3B:
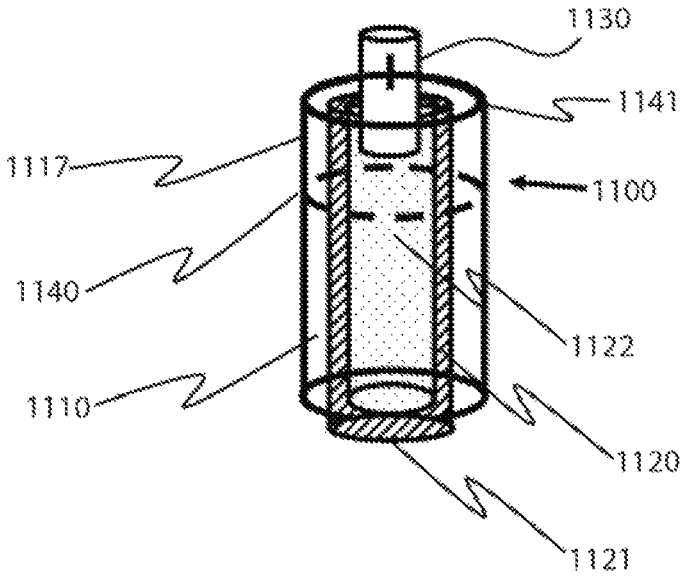
FIG. 3B is a simplified side-cut view of the integrated bulb/output coupling-element assembly shown in FIG. 3A comprising multiple sections including an output coupling-element, a gas-fill vessel that is the bulb, and a top coupling-element according to an embodiment of the present invention.

FIG. 3B is a side-cut view of an integrated bulb/output coupling-element assembly 1100 shown in FIG. 3A. This diagram is merely an example, which should not unduly limit the scope of the claims herein. One of ordinary skill in the art would recognize other variations, modifications, and alternatives. The assembly can be made from a single piece of material such as a hollow quartz tube or translucent alumina, or it can be made from three different pieces and assembled together.

Figure 4:
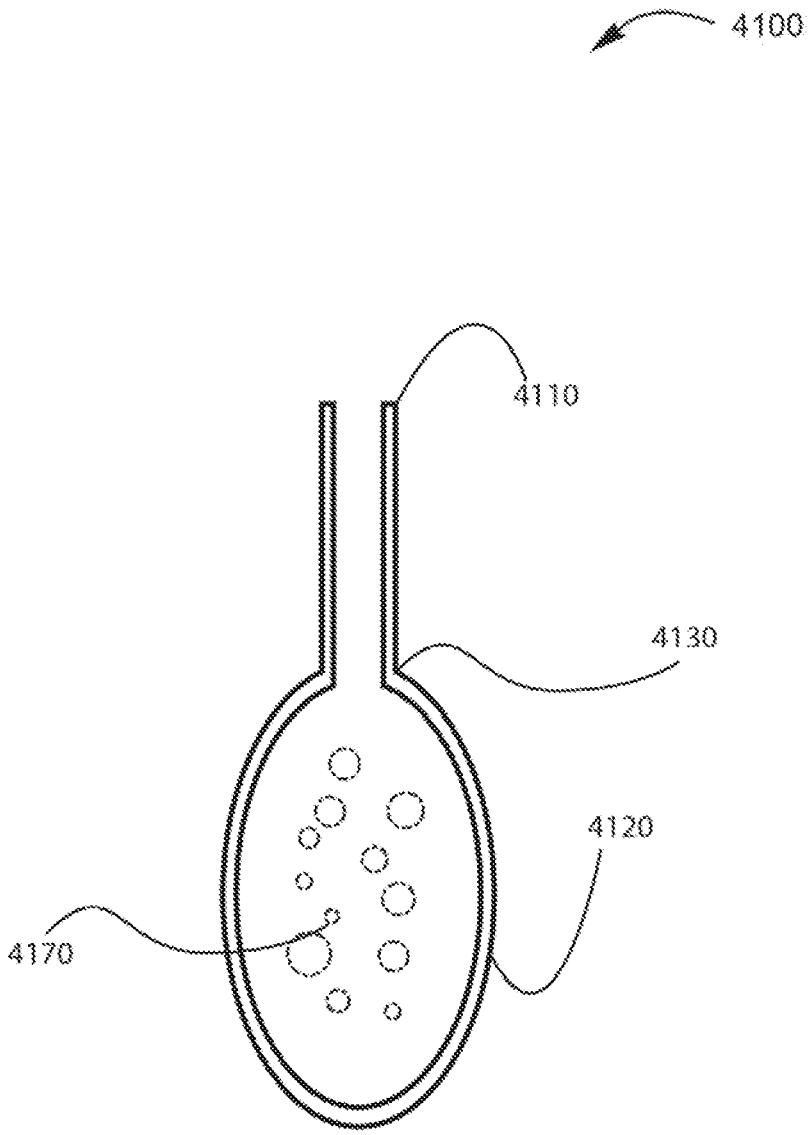
FIG. 4 is a simplified diagram of a plasma lamp apparatus according to an embodiment of the present invention.

FIG. 4 is a simplified diagram of a plasma lamp apparatus according to an embodiment of the present invention. This diagram is merely an example, which should not unduly limit the scope of the claims herein. As shown, device 4000 can include a bulb, which can be an arc tube structure. The bulb can include a quartz, translucent alumina, or substantially transparent material. In an embodiment, the arc tube structure can include a first end 4010 associated with a first end diameter and a second end 4020 associated with a second end diameter. Device 4000 can also have a center region 4030 that is provided between first end 4010 and second end 4020. Center region 4030 can have a center diameter that is less than the first or second end diameter. One of ordinary skill in the art would recognize other variations, modifications, and alternatives.

In a specific embodiment, the arc tube structure can be configured with an aspect ratio ranging from 1.5 to 3.5. Also, the arc tube structure can be made of a quartz, translucent alumina, or other material or combination thereof. Second end 4020 can be elevated relative to first end 4010, or vice versa. An arc can be substantially exposed from center region 4030 to second end 4020. In a specific embodiment, center region 4030 can be spatially configured to cause a uniform temperature profile within the inner region from the center region to the second region. Center region 4030 can also be configured to maintain a vicinity of the inner region within a proximity of center region 4030 substantially free from an opaque fluid material. The arc tube structure can also be coupled to an rf source or an rf coupling element that is coupled to an rf source. Also, the arc tube structure can be coupled to a resonator, or other related device or combination of devices thereof. Those skilled in the art will recognize other variations, modifications, and alternatives.

In a specific embodiment, Device 4000 can also include a fill material 4070, which can be disposed within the inner region of the arc tube structure. Fill material 4070 can be configured to discharge a substantially white light. The discharged light can be representative of a black body source and can provide at least 120 lumens per watt. Fill material 4070 can include thulium bromide, indium bromide, dysprosium bromide, holmium bromide, and Argon gas. In a specific embodiment, the amount of thulium bromide can be provided within a range between about two to about seventeen milligrams per cubic centimeter. The amount of indium bromide can also be provided within a range between about two to about seventeen milligrams per cubic centimeter. The amount of dysprosium bromide and/or holmium bromide can be provided within a range between about zero to about seventeen milligrams per cubic centimeter. On the other hand, the amount of mercury can be provided within a range between about eight to about twelve milligrams per cubic centimeter. In other embodiments, the amounts of elements in the fill material can vary and the ratios between elements can differ. The amount of dysprosium bromide, thulium bromide, and holmium bromide can be a determined amount to cause a selected color temperature, which can range from about 3500 Kelvin to about 5000 Kelvin. Also, the amount of Argon can provided within a pressure range between about 50 torr to about 600 torr. These fill materials and other fill materials can be provided, combined or uncombined, for various vendors. Of course, there can be other variations, modifications, and alternatives.

In various embodiments, the device 4000 can have a bulb coupled to at least the first end of a support member that is provided within a housing having an interior and exterior region. The housing can also have a first coupling member disposed within the housing, and a gap can be provided between the first coupling member and the support member. Additionally an rf source can be coupled to the support member. A fill material 4070, which can include at least a first volume of a rare gas, a first amount of a first metal halide, a second amount of a second metal halide, and a third amount of mercury, can be spatially disposed within the bulb. Those skilled in the art will recognize other variations, modifications, and alternatives.

In various embodiments, fill material 4070 can include thulium bromide, indium bromide, liquid mercury, dysprosium bromide, and holmium bromide. In a specific embodiment, the amount of thulium bromide can be provided within a first range, which can be associated with a concentration ranging from about two to about seventeen milligrams per cubic centimeters. The amount of indium bromide can also be provided within a second range, which can be associated with a concentration ranging from about two to about seventeen milligrams per cubic centimeters. On the other hand, the amount of mercury can be provided within a third range, which can be associated with a concentration ranging from about eight to about twelve milligrams per cubic centimeters. Also, the amount of dysprosium bromide can be provided within a fourth range, which can be associated with a concentration ranging from about zero to about seventeen milligrams per cubic centimeters. The amount of holmium bromide can be provided within a fifth range, which can be associated with a concentration ranging from about two to about seventeen milligrams per cubic centimeters. In other embodiments, the amounts of elements in fill material 4070 can vary and the ratios between elements can differ. The amount of dysprosium bromide, holmium bromide, and thulium bromide can be a determined amount to cause a selected color temperature, which can range from about 3500 Kelvin to about 5000 Kelvin.

In another embodiment, the following substances can be provided in fill material 4070: a first volume of a rare gas, a first mount of a first metal halide, a second amount of a second metal halide, and a third amount of mercury. The first metal halide can include indium halide, aluminum halide, gallium halide, or the like, where the halide can be selected from chlorine, iodine, or bromine. The second metal halide can include at least one lanthanide element, which can include thulium, dysprosium, holmium, cerium, ytterbium, or the like. The halide component of the lanthanide metal halides can be selected from chlorine, iodine, or bromine. The rare gas can include argon gas, xenon gas, krypton gas, or the like, as well as a starting aid such as radioactive krypton-85 gas. In various embodiments, the krypton-85 radioactive gas can range in concentration from about 3 nanoCuries/$cm^3$ to about 400 nanoCuries/$cm^3$. The third amount of mercury can be mercury liquid, which can be maintained in a liquid state substantially free from a vapor phase. In an embodiment, the mercury liquid can be metered using a syringe device. Of course, there can be other variations, modifications, or alternatives.

Figure 5:
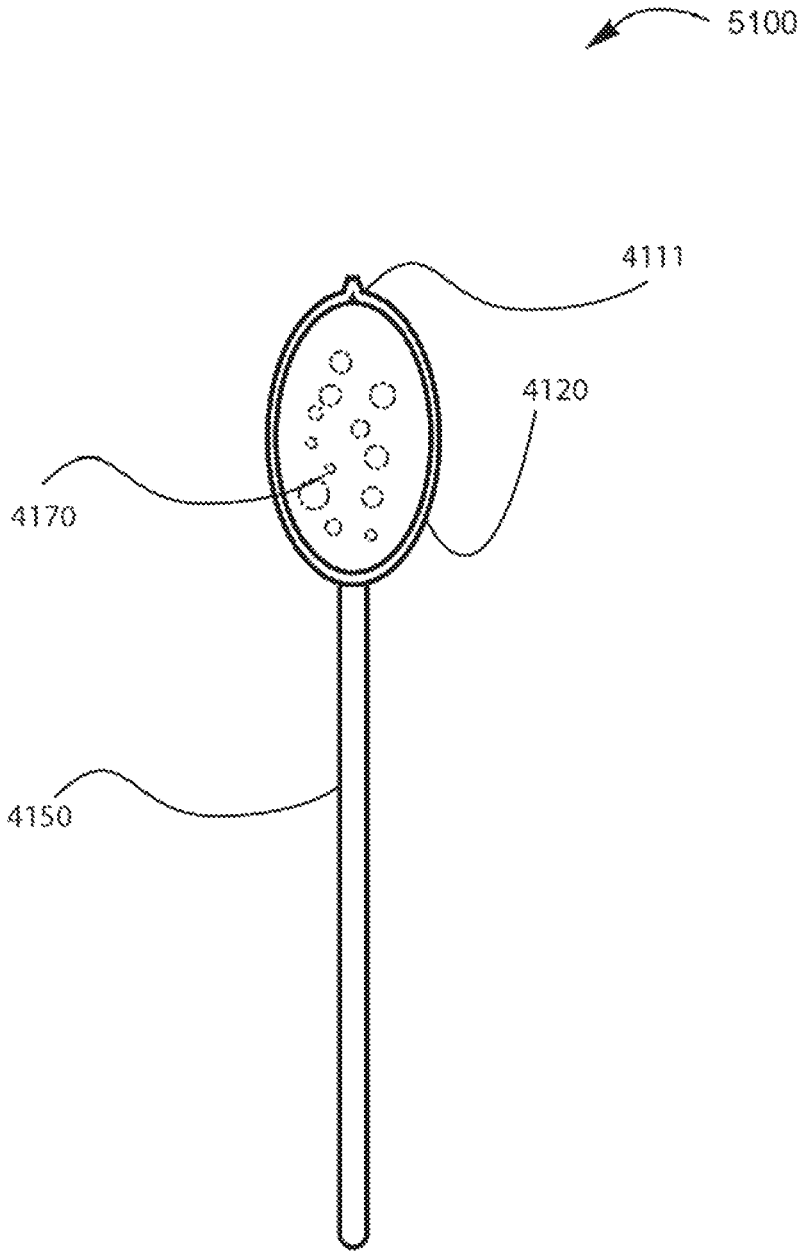
FIG. 5 is a simplified diagram of a plasma lamp apparatus according to an embodiment of the present invention.

FIG. 5 is a simplified diagram of a plasma lamp apparatus according to an embodiment of the present invention. This diagram is merely an example, which should not unduly limit the scope of the claims herein. As shown, device 5000 can include a bulb, which can be an arc tube structure having an inner region and an outer region, a fill material 4070, and a stem structure 4050. In an embodiment, the arc tube structure can include a first end 4010 associated with a first end diameter and a second end 4020 associated with a second end diameter. Device 4000 can also have a center region 4030 that is provided between first end 4010 and second end 4020. Center region 4030 can have a center diameter that is less than the first or second end diameter. A detailed description of the components found within the arc tube structure can be found above in the description for FIG. 4. One of ordinary skill in the art would recognize other variations, modifications, and alternatives.

In a specific embodiment, stem structure 4050 can be a solid structure or a hollow structure. Stem structure 4050 can be shaped in a rod like manner or be configured to be inserted into a support member. In other embodiments, stem structure 4050 can be integrated from at least one end of the arc tube structure, which can be a quartz rod structure that is integrally coupled to the arc tube structure. Of course, those skilled in the art will recognize other variations, modifications, or alternatives.

Figure 6:
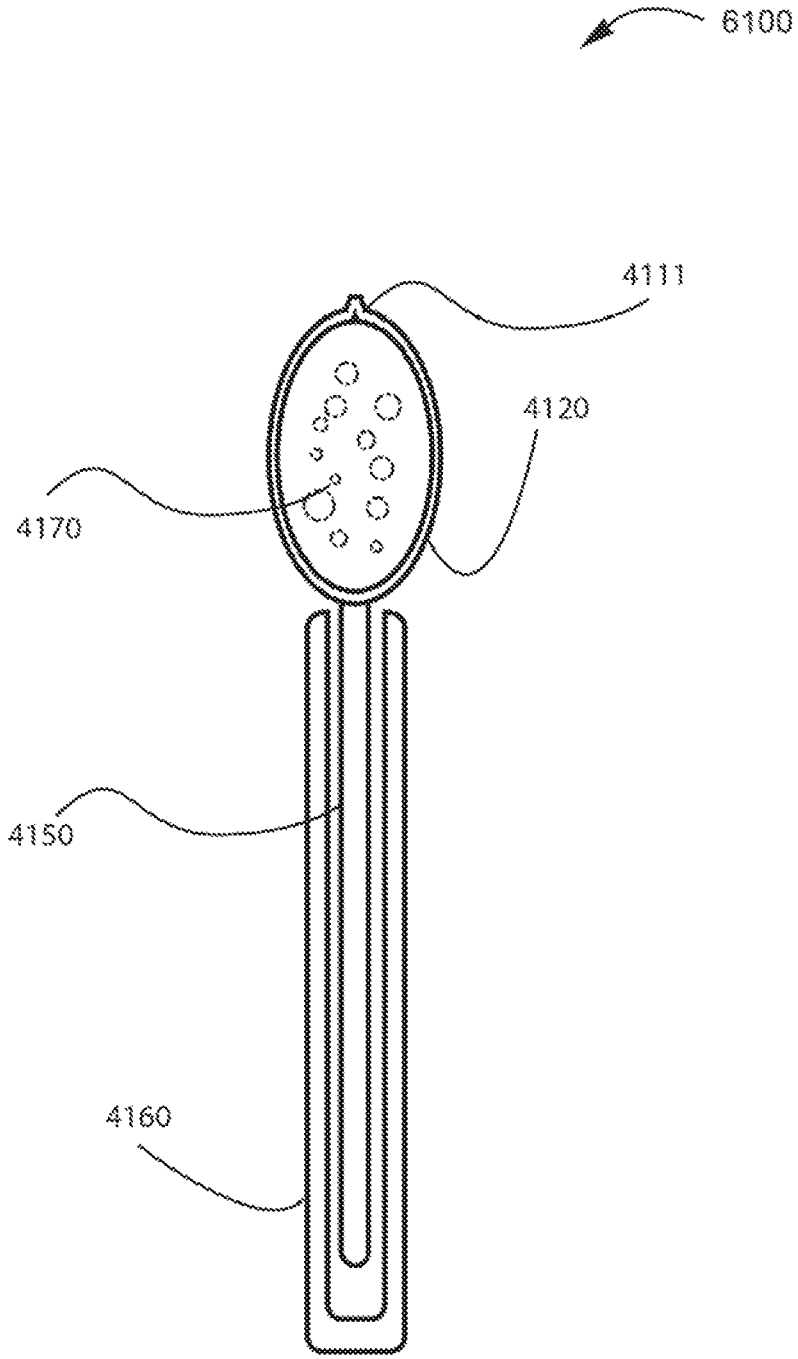
FIG. 6 is a simplified diagram of a plasma lamp apparatus according to an embodiment of the present invention.

FIG. 6 is a simplified diagram of a plasma lamp apparatus according to an embodiment of the present invention. This diagram is merely an example, which should not unduly limit the scope of the claims herein. As shown, device 6000 can include an arc tube structure having an inner region and an outer region, a fill material 4070, a stem structure 4050, and a support member 4060. In an embodiment, the arc tube structure can include a first end 4010 associated with a first end diameter and a second end 4020 associated with a second end diameter. Device 4000 can also have a center region 4030 that is provided between first end 4010 and second end 4020. Center region 4030 can have a center diameter that is less than the first or second end diameter. A detailed description of the components found within the arc tube structure and stem structure can be found above in the descriptions for FIG. 4 and FIG. 5. Additionally, device 6000 can have a housing having an interior region and an exterior region, the interior region configured with a spatial volume. In various embodiments, a support member can be provided within an interior region of the housing. The support member can have at least a conductive exterior region and have a first end and a second end. In a specific embodiment, a first coupling member can be disposed within the spatial volume of the housing. A gap can also be provided between the first coupling member and the support member. Also, device 6000 can further comprise a luminous flux of at least 20000 lumens. One of ordinary skill in the art would recognize other variations, modifications, and alternatives.

Figure 7:
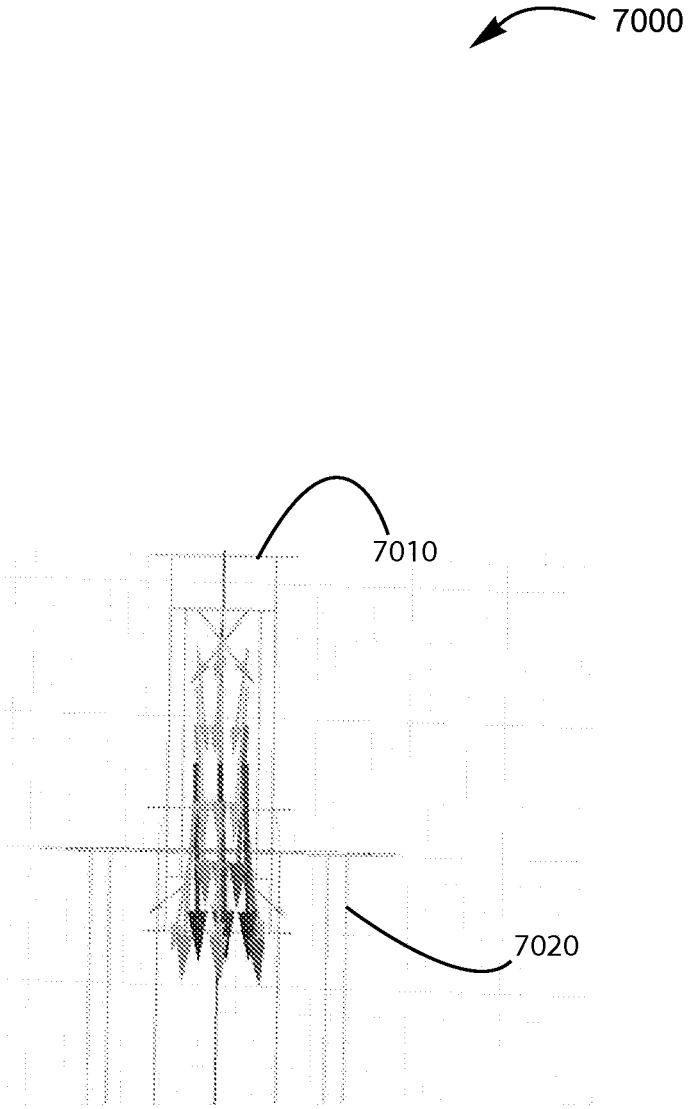
FIG. 7 is a simplified diagram of an intensity field simulation for a plasma lamp apparatus according to an embodiment of the present invention.

FIG. 7 is a simplified diagram of an intensity field simulation for a plasma lamp apparatus according to an embodiment of the present invention. This'diagram is merely an example, which should not unduly limit the scope of the claims herein. This figure shows the simulation results of microwave electric field intensity inside the arc tube structure at one moment in time during operation. An arc tube structure 7010 and a resonator 7020 are shown. The intensity of the field is indicated by the length of the arrows, which shows the highest intensity near one end of the arc tube structure. It can be noted that the field intensity is independent of the orientation of the lighting device in which the arc tube is installed.

Figure 8:
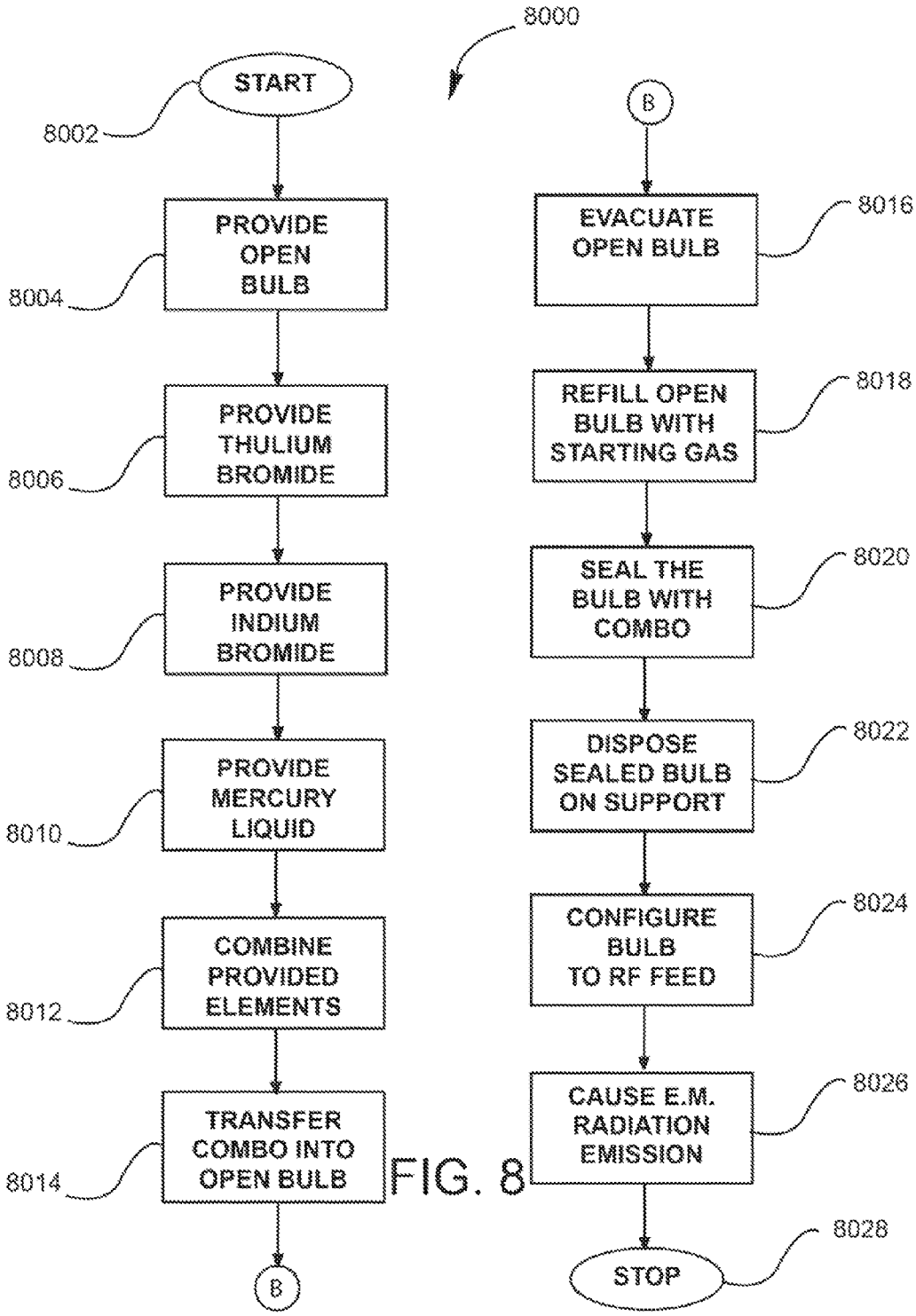
FIG. 8 is a simplified flow diagram of a method for manufacturing a plasma lamp apparatus according to an embodiment of the present invention.

FIG. 8 is a simplified flow diagram of a method for manufacturing a plasma lamp apparatus according to an embodiment of the present invention. It is also understood that the examples and embodiments described herein are for illustrative purposes only and that various modifications or changes in light thereof will be suggested to persons skilled in the art and are to be included within the spirit and purview of this process and scope of the appended claims.

As shown in FIG. 8, the present method can be briefly outlined below.

1. Start;
2. Provide an open bulb;
3. Provide particle(s) of thulium bromide;
4. Provide particle(s) of indium bromide;
5. Provide liquid mercury;
6. Combine provided substances;
7. Transfer combination into the open bulb;
8. Evacuate open bulb;
9. Refill open bulb with starting gas;
10. Seal the open bulb with the combination;
11. Dispose the sealed bulb on a support;
12. Configure sealed bulb to an rf feed;
13. Cause E.M. radiation emission from combination; and
14. Stop.

These steps are merely examples and should not unduly limit the scope of the claims herein. As shown, the above method provides a way of manufacturing a plasma lamp apparatus according to an embodiment of the present invention. One of ordinary skill in the art would recognize many other variations, modifications, and alternatives. For example, various steps outlined above may be added, removed, modified, rearranged, repeated, and/or overlapped, as contemplated within the scope of the invention.

As shown in FIG. 8, method 8000 begins at start, step 8002. The present method provides a manufacturing method for a plasma lamp apparatus. Many benefits are achieved by way of the present invention over conventional techniques. These and other benefits will be described in more throughout the present specification.

Following step 8002, an open bulb can be provided, step 8004. The bulb can have an internal volume ranging from about 0.2 cubic centimeters to about 0.5 cubic centimeters. In a specific embodiment, the bulb can be an arc tube structure configured with an aspect ratio ranging from 1.5 to 3.5. The arc tube structure can have a first end associated with a first diameter, and a second end associated with a second diameter. The arc tube structure can also have a center region that is provided between first end and second end. The center region can have a center diameter that is less than the first or second end diameter. Also, the arc tube structure can be made of a quartz, translucent alumina, or other material or combination thereof. The second end can be elevated relative to the first end, or vice versa. An arc can be substantially exposed from the center region to the second end. In a specific embodiment, the center region can be spatially configured to cause a uniform temperature profile within the inner region from the center region to the second region. The center region can also be configured to maintain a vicinity of the inner region within a proximity of the center region substantially free from an opaque fluid material. The arc tube structure can also be coupled to an rf source or an rf coupling element that is coupled to an rf source. Also, the arc tube structure can be coupled to a resonator, or other related device or combination of devices thereof. Those skilled in the art will recognize other variations, modifications, and alternatives.

One or more particles of the following substances can be provided: thulium bromide (step 8006), indium bromide (step 8008), and liquid mercury (step 8010). In a specific embodiment, the amount of thulium bromide can range from a concentration of about two to about seventeen milligrams per cubic centimeters. The amount of indium bromide can also range from a concentration of about two to about seventeen milligrams per cubic centimeters. On the other hand, the amount of mercury can range from a concentration of about eight to about twelve milligrams per cubic centimeters. In other embodiments, the amounts of elements in the fill material can vary and the ratios between elements can differ. Dysprosium bromide and/or holmium bromide can be added to the combination at a concentration of about two to about seventeen milligrams per cubic centimeters. The amount of dysprosium bromide and/or holmium bromide can be a determined amount to cause a selected color temperature, which can range from about 3500 Kelvin to about 5000 Kelvin. These fill materials and other fill materials can be provided, combined or uncombined, for various vendors. There can be other variations, modifications, and alternatives.

In another embodiment, the following substances can be provided: a first volume of a rare gas, a first mount of a first metal halide, a second amount of a second metal halide, and a third amount of mercury. The first metal halide can include indium halide, aluminum halide, gallium halide, or the like, where the halide can be selected from chlorine, iodine, or bromine. The second metal halide can include at least one lanthanide element, which can include thulium, dysprosium, holmium, cerium, ytterbium, or the like. The halide component of the lanthanide metal halides can be selected from chlorine, iodine, or bromine. The rare gas can include argon gas, xenon gas, krypton gas, or the like, as well as a starting aid such as radioactive krypton-85 gas. The third amount of mercury can be mercury liquid, which can be maintained in a liquid state substantially free from a vapor phase. In an embodiment, the mercury liquid can be metered using a syringe device. Of course, there can be other variations, modifications, or alternatives.

The provided substances can be combined into a first combination, step 8012. The first combination can be configured to discharge a substantially white light. The discharged light can be representative of a black body source and can provide at least 120 lumens per watt. The first combination can include thulium bromide, indium bromide, dysprosium bromide, holmium bromide, and Argon. In various embodiments, the first combination can be maintained at a temperature ranging from about 700 degrees Celsius to about 1000 degrees Celsius. In an embodiment, the bulb can also be evacuated. The evacuation process can be done via a vacuum, motor device, or other any other evacuation device. One or more starting gases can be disposed within the inner region of the bulb or arc tube structure. In an embodiment, the starting gas(es) can include Argon. The amount of Argon disposed within the inner region can be about 200 Torr, or any other determined amount. In various embodiments, the one or more particles of thulium bromide can range from about 0.1 to 0.6 mg, the one or more particles of indium bromide can range from about 0.1 to 0.6 mg, and the mercury liquid can range from about 2.5 to 3.5 mg for a volume of about 0.3 cubic centimeters. The first combination can then be transferred into the open bulb, step 8014. Of course, there can be other variations, modifications, and alternatives.

The open bulb can then be evacuated, step 8016. The evacuation process can be done via a vacuum, motor device, or other any other evacuation device. One or more starting gases can be used to refill the internal volume of the open bulb, step 8018. In an embodiment, the starting gas(es) can include Argon. The amount of Argon gas, or other starting gas, disposed within the inner region can be provided at a pressure ranging from about 50 torr to 600 torr, or any other determined amount. Of course, there can be other variations, modifications, and alternatives.

The bulb can then be sealed with the first combination, step 8020. The open bulb can be sealed with the first combination by a heat process. The heat (thermal) process can be characterized by a flame at a temperature ranging from about 1500 to 2500 degrees Celsius. The heat process can also be provided by any other means of transferring energy to the arc tube structure to cause a temperature increase. The sealed bulb can then be disposed on a support member, step 8022, and configured to an rf feed, step 8024. The resulting device can then be used to cause an electromagnetic radiation emission derived from at least the first combination, step 8026. Of course, those skilled in the art will recognize other variations, modifications, or alternatives.

The above sequence of processes provides a manufacturing method for a plasma lamp apparatus according to an embodiment of the present invention. As shown, the method uses a combination of steps including providing an open bulb, providing one or more particles of several substances, evacuating and refilling the bulb, sealing the bulb with the fill material, and configuring the bulb with a support member and an rf feed. The apparatus can then be caused to emit an electromagnetic radiation emission derived from at least the fill material. Other alternatives can also be provided where steps are added, one or more steps are removed, or one or more steps are provided in a different sequence without departing from the scope of the claims herein.

Figure 9:
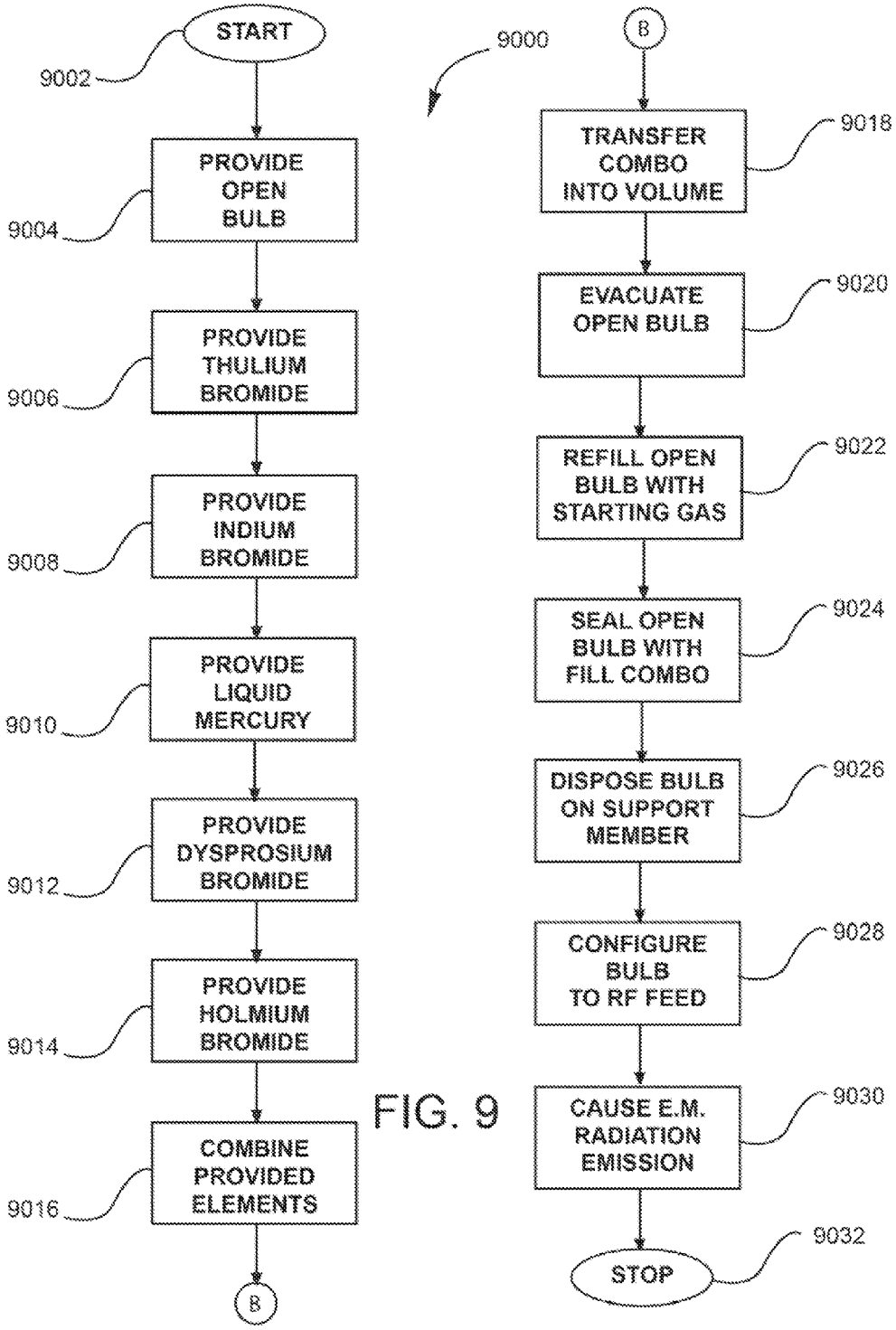
FIG. 9 is a simplified flow diagram of a method for manufacturing a plasma lamp apparatus according to an embodiment of the present invention.

FIG. 9 is a simplified flow diagram of a method for manufacturing a plasma lamp apparatus according to an embodiment of the present invention. It is also understood that the examples and embodiments described herein are for illustrative purposes only and that various modifications or changes in light thereof will be suggested to persons skilled in the art and are to be included within the spirit and purview of this process and scope of the appended claims.

As shown in FIG. 9, the present method can be briefly outlined below.

1. Start;
2. Provide an open bulb;
3. Provide thulium bromide within a first range;
4. Provide indium bromide within a second range;
5. Provide liquid mercury within a third range;
6. Provide dysprosium bromide within a fourth range;
7. Provide holmium bromide fifth range;
8. Combine provided substances into a first combination;
9. Transfer the first combination into a volume defined by the open bulb;
10. Evacuate the open bulb;
11. Refill the open bulb with starting gas(es);
12. Seal the open bulb with the first combination;
13. Dispose the sealed bulb on a support member;
14. Configure the bulb and support member to an rf feed;
15. Cause electromagnetic radiation emission derived from at least the first combination; and
16. Stop.

These steps are merely examples and should not unduly limit the scope of the claims herein. As shown, the above method provides a way of manufacturing a plasma lamp apparatus according to an embodiment of the present invention. One of ordinary skill in the art would recognize many other variations, modifications, and alternatives. For example, various steps outlined above may be added, removed, modified, rearranged, repeated, and/or overlapped, as contemplated within the scope of the invention.

As shown in FIG. 9, method 9000 begins at start, step 9002. The present method provides a manufacturing method for a plasma lamp apparatus. Many benefits are achieved by way of the present invention over conventional techniques. These and other benefits will be described in more throughout the present specification.

Following step 9002, an open bulb can be provided, step 9004. The open bulb can have an internal volume ranging from about 0.2 cubic centimeters to about 0.5 cubic centimeters. Also, the open bulb can be an arc tube structure having an arc tube region. In a specific embodiment, the arc tube structure can be configured with an aspect ratio ranging from 1.5 to 3.5. The arc tube structure can have a first end associated with a first diameter, and a second end associated with a second diameter. The arc tube structure can also have a center region that is provided between first end and second end. The center region can have a center diameter that is less than the first or second end diameter. Also, the arc tube structure can be made of a quartz, translucent alumina, or other material or combination thereof. The second end can be elevated relative to the first end, or vice versa. An arc can be substantially exposed from the center region to the second end. In a specific embodiment, the center region can be spatially configured to cause a uniform temperature profile within the inner region from the center region to the second region. The center region can also be configured to maintain a vicinity of the inner region within a proximity of the center region substantially free from an opaque fluid material. The arc tube structure can also be coupled to an rf source or an rf coupling element that is coupled to an rf source. Also, the arc tube structure can be coupled to a resonator, or other related device or combination of devices thereof. Those skilled in the art will recognize other variations, modifications, and alternatives.

One or more particles of the following substances can be provided: thulium bromide (step 9006), indium bromide (step 9008), liquid mercury (step 9010), dysprosium bromide (step 9012), and holmium bromide (step 9014). In a specific embodiment, the amount of thulium bromide can be provided within a first range, which can be associated with a concentration ranging from about two to about seventeen milligrams per cubic centimeters. The amount of indium bromide can also be provided within a second range, which can be associated with a concentration ranging from about two to about seventeen milligrams per cubic centimeters. On the other hand, the amount of mercury can be provided within a third range, which can be associated with a concentration ranging from about eight to about twelve milligrams per cubic centimeters. Also, the amount of dysprosium bromide can be provided within a fourth range, which can be associated with a concentration ranging from about zero to about seventeen milligrams per cubic centimeters. The amount of holmium bromide can be provided within a fifth range, which can be associated with a concentration ranging from about two to about seventeen milligrams per cubic centimeters. In other embodiments, the amounts of elements in the fill material can vary and the ratios between elements can differ. The amount of dysprosium bromide, holmium bromide, and thulium bromide can be a determined amount to cause a selected color temperature, which can range from about 3500 Kelvin to about 5000 Kelvin. These fill materials and other fill materials can be provided, combined or uncombined, for various vendors. There can be other variations, modifications, and alternatives.

In another embodiment, the following substances can be provided: a first volume of a rare gas, a first mount of a first metal halide, a second amount of a second metal halide, and a third amount of mercury. The first metal halide can include indium halide, aluminum halide, gallium halide, or the like, where the halide can be selected from chlorine, iodine, or bromine. The second metal halide can include at least one lanthanide element, which can include thulium, dysprosium, holmium, cerium, ytterbium, or the like. The halide component of the lanthanide metal halides can be selected from chlorine, iodine, or bromine. The rare gas can include argon gas, xenon gas, krypton gas, or the like, as well as a starting aid such as radioactive krypton-85 gas. The third amount of mercury can be mercury liquid, which can be maintained in a liquid state substantially free from a vapor phase. In an embodiment, the mercury liquid can be metered using a syringe device. Of course, there can be other variations, modifications, or alternatives.

The provided substances can be combined into a first combination, step 9016. The first combination can be configured to discharge a substantially white light. The discharged light can be representative of a black body source and can provide at least 120 lumens per watt. The first combination can include thulium bromide, indium bromide, dysprosium bromide, holmium bromide, and Argon. In an embodiment, the bulb can also be evacuated. In various embodiments, the first combination can be maintained at a temperature ranging from about 700 degrees Celsius to about 1000 degrees Celsius. The evacuation process can be done via a vacuum, motor device, or other any other evacuation device. One or more starting gases can be disposed within the inner region of the bulb or arc tube structure. In an embodiment, the starting gas(es) can include Argon. The amount of Argon disposed within the inner region can be about 200 Torr, or any other determined amount. The first combination can then be transferred into a volume defined by the open bulb, step 9018. Of course, there can be other variations, modifications, and alternatives.

The open bulb can then be evacuated, step 9020. The evacuation process can be done via a vacuum, motor device, or other any other evacuation device. One or more starting gases can be used to refill the internal volume of the open bulb, step 9022. In an embodiment, the starting gas(es) can include Argon, Xenon, Krypton, or other rare gases. The amount of Argon disposed within the inner region can be about 200 Torr, or any other determined amount. In various embodiments, Krypton-85 radioactive gas can be combined into the starting gas. The starting gas can also include any other rare gas, or other rare element in gaseous form. Of course, there can be other variations, modifications, and alternatives.

The bulb can then be sealed with the first combination, step 9024. The open bulb can be sealed with the first combination by a heat process. The heat (thermal) process can be characterized by a flame at a temperature ranging from about 1500 to 2500 degrees Celsius. The heat process can also be provided by any other means of transferring energy to the arc tube structure to cause a temperature increase. The sealed bulb can then be disposed on a support member, step 9026, and configured to an rf feed, step 9028. The resulting device can then be used to cause an electromagnetic radiation emission derived from at least the first combination, step 9030. Of course, those skilled in the art will recognize other variations, modifications, or alternatives.

The above sequence of processes provides a manufacturing method for a plasma lamp apparatus according to an embodiment of the present invention. As shown, the method uses a combination of steps including providing an open bulb, providing one or more particles of several substances, evacuating and refilling the bulb, sealing the bulb with the first combination, and configuring the bulb with a support member and an rf feed. The apparatus can then be caused to emit an electromagnetic radiation emission derived from at least the first combination. Other alternatives can also be provided where steps are added, one or more steps are removed, or one or more steps are provided in a different sequence without departing from the scope of the claims herein.

Figure 10A:
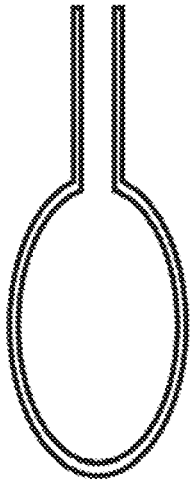
FIGS. 10A, 10B, 10C, and 10D are simplified diagrams of a plasma lamp apparatus during various phases of manufacturing according to an embodiment of the present invention.
Figure 10B:
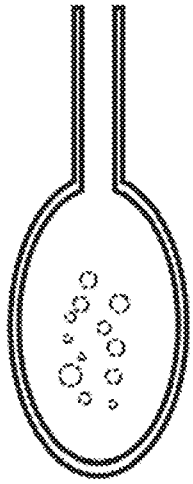
Figure 10C:
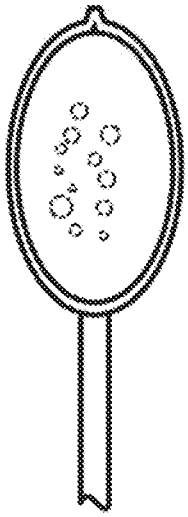
Figure 10D:
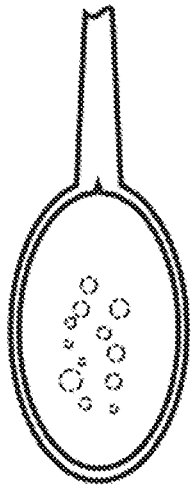

FIGS. 10A, 10B, and 10C are simplified diagrams of a plasma lamp apparatus during various phases of manufacturing according to an embodiment of the present invention. These diagrams are merely examples, which should not unduly limit the scope of the claims herein. A detailed description of the arc tube structure, stem structure, and fill material contents can be found above in the description for FIGS. 4 and 5. As shown, the following FIGS. 10A-D depict different stages of the manufacturing process of one or more embodiments of the present invention. Details regarding the methods of manufacturing can be found above in the descriptions for FIGS. 8 and 9. FIG. 10A shows an arc tube structure, which can have an opening. FIG. 10B shows a fill material being disposed within the inner region of the arc tube structure. FIG. 10C shows an embodiment of the stem structure wherein the stem structure is coupled to a portion of the arc tube structure. FIG. 10D shows another embodiment of the stem structure wherein the stem structure is formed via a thermal process.

Figure 11:
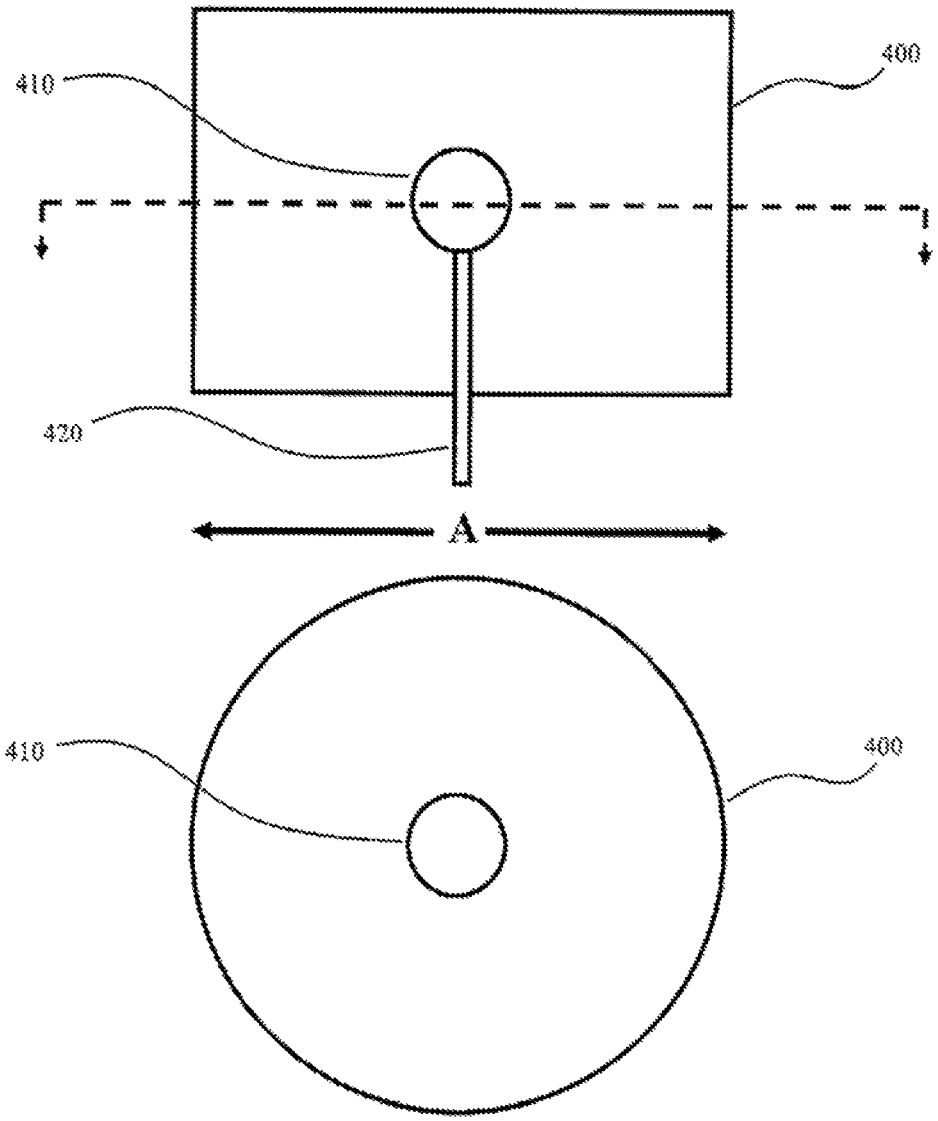
FIG. 11 illustrates an example of conventional air resonator/waveguide coupling RF energy to a gas filled vessel (bulb)

FIG. 11 illustrates an example of a conventional air resonator/waveguide coupling RF energy to a gas filled vessel (bulb). The air resonator 400 surrounds the gas filled vessel 410 that is attached to a stem 420. The cross section of the resonator is illustrated at the bottom of FIG. 11. The dimension A shown in the figure corresponds to the diameter of an air resonator operating at the fundamental resonant mode of 900 MHz and is approximately 16.5 cm which is about half of the free space wavelength at 900 MHz (it is typically half the free space guide wavelength which is the effective wavelength inside the waveguide). The size of this resonator is too large for most luminaires. Furthermore, the arc of the bulb is fully surrounded by the walls of the resonator making it difficult to use with conventional reflectors and optics in designing the luminaire.

Figure 12:
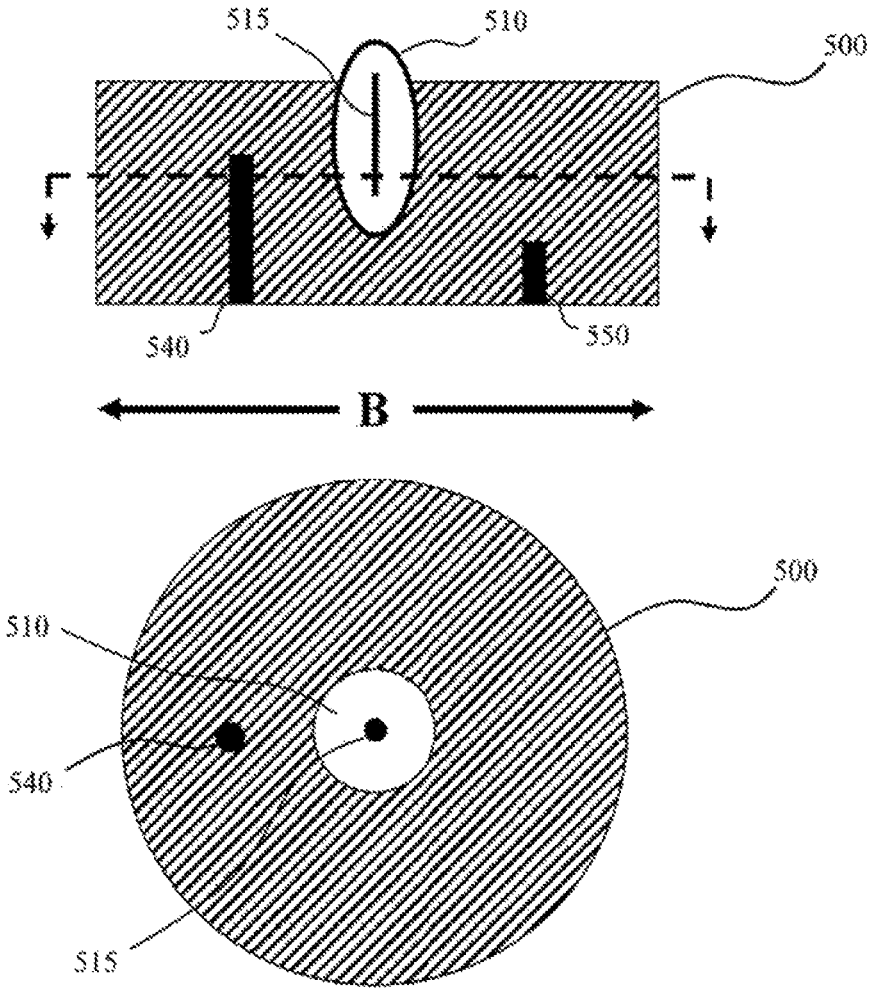
FIG. 12 illustrates an example of conventional dielectric resonator/waveguide coupling RF energy to a gas-fill vessel (bulb)

FIG. 12 illustrates an example of a conventional dielectric resonator/waveguide coupling RF energy to a gas filled vessel (bulb). The RF energy is coupled into the dielectric resonator 500 using an input probe 540. The resonator couples the RF energy to the gas filled vessel 510 that is placed inside the dielectric resonator with most of the arc 515 being surrounded by the dielectric resonator. A feedback probe 550 can be used to couple a small amount of RF energy out of the resonator and in conjunction with an amplifier and the input probe form a feedback loop to power up the lamp. The cross section of this resonator is illustrated at the bottom of FIG. 12 with dimension B corresponding to the diameter of this resonator. One advantage of this approach over an air resonator shown in FIG. 11 is that the size of the resonator (designed for fundamental mode of operation) is reduced approximately by the square root of the effective dielectric constant of the dielectric material. So for example in the case that the resonator is made from Alumina with a dielectric constant of 9.4 the diameter of a 900 MHz air resonator shown in FIG. 11 is reduced by a factor of approximately 3 to about 5.3 cm (dimension B). The drawback of this approach is that the resonator has to be made from a low RF loss dielectric material and the resonator is more expensive and more difficult to manufacture. Furthermore, most of the arc of the bulb 515 is inside the dielectric material so it is not accessible for more flexibility in the design of the optical components used in luminaires. These and other limitations have been overcome with one or more embodiments of the present invention, which will be described in more detail below.

Figure 13:
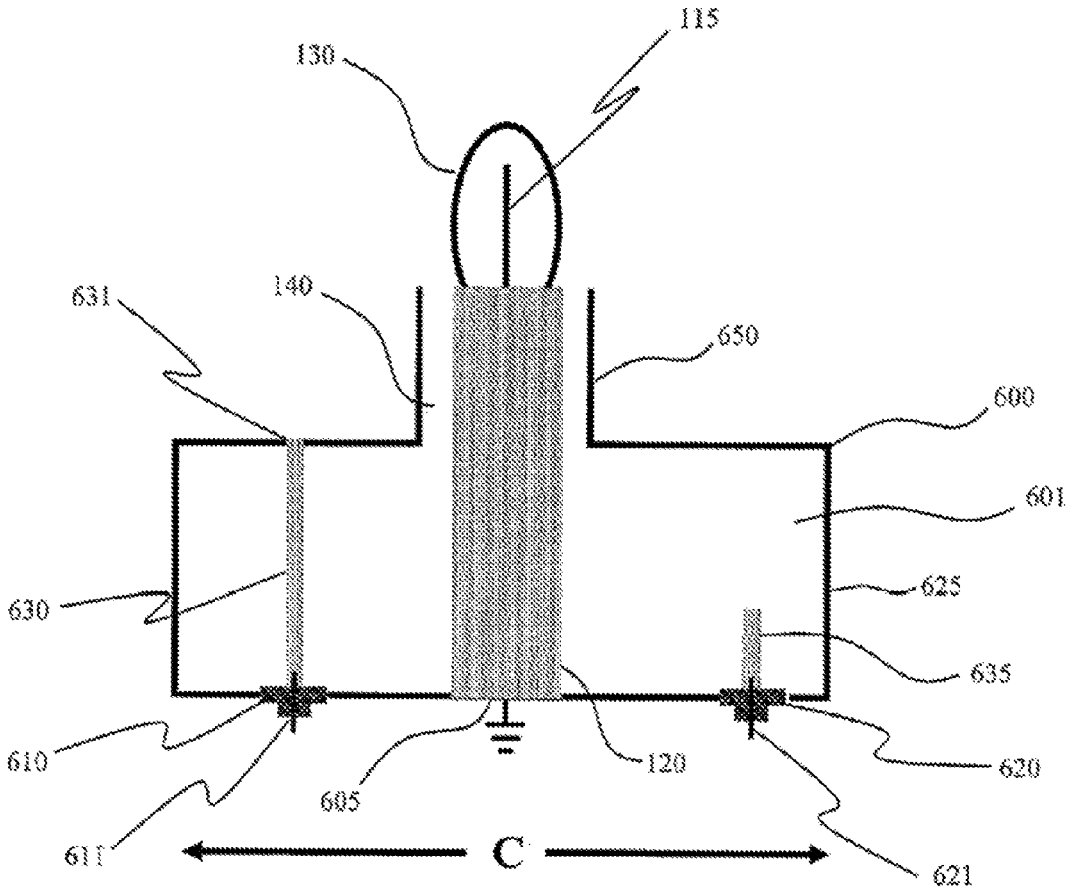
FIG. 13 is a simplified drawing of an embodiment of the present invention of a compact air resonator/waveguide comprising a conductive lamp body with air inside, an input coupling element, an integrated bulb/output coupling element, and a feedback coupling element.

FIG. 13 is a simplified drawing of an embodiment of the present invention of a compact air resonator/waveguide. This diagram is merely example, which should not unduly limit the scope of the claims herein. One of ordinary skill in the art would recognize other variations, alternatives, and modifications. The lamp housing 600 is made from an electrically conductive material. This conductivity may be achieved through the application of a conductive veneer, or through the choice of a conductive material. An example embodiment of conductive veneer is silver paint or alternatively the lamp body can be made from sheet of electrically conductive material such as aluminum. In this embodiment the lamp body consists of a wider diameter bottom section 625 and a narrower diameter 650 top section. A cylindrical lamp body is depicted, but rectangular or other shapes may be used. The input coupling element 630 is connected to the lamp body at the top surface 631 and at the other end is connected to an RF connector 611 through the opening 610 in the lamp body. The input coupling element 630 can be made from a solid or hollow conductor or alternatively from a dielectric material with an electrically conductive coating. The output coupling element 120 is connected to the lamp body at the bottom 605 and at the other end is connected to the gas filled vessel (bulb) 130. The output coupling element can be made from solid or hollow electrically conductive material or alternatively can be made from a dielectric material with an electrically conductive coating. The top end of the output coupling element is shaped to closely receive the gas filled vessel. In the case that the output coupling element is made from a solid conductor a thin layer of a dielectric material or refractory metal is used as an interface barrier between the bulb and the output coupling element. In a specific embodiment the gas filled vessel is made of a suitable material such as quartz or translucent alumina or other transparent or translucent material. The gas filled vessel is filled with an inert gas such as Argon or Xenon and a light emitter such as Mercury, Sodium, Sulfur or a metal halide salt such as Indium Bromide, Scandium Bromide, Thallium Iodide, Holmium Bromide, Cesium Iodide or other similar materials (or it can simultaneously contain multiple light emitters). Overall, RF energy is coupled capacitively, or inductively, or a combination of inductively and capacitively, by the output coupling-element 120 to the bulb 130, ionizing the inert gas and vaporizing the light emitter(s) resulting in intense light emitted from the lamp. The arc of the bulb 115 in this embodiment is not surrounded by the walls of the resonator/waveguide. The feedback coupling element 635 is connected to an RF connector 621 through an opening 620 in the lamp body. The other end of the feedback coupling element is not connected to the lamp body.

The resonant frequency of the compact air resonator/waveguide depends on a number of parameters including the diameter and length of the top (650) and bottom (625) sections, the length and diameter of the output coupling element (120), and the gap 140 between the output coupling element and the walls of the lamp body. By adjusting these parameters as well as other parameters of the compact air resonator/waveguide it is possible to design the resonator to operate at different resonant frequencies. By adjusting the lengths and the gap between the input coupling element (630) and the output coupling element (120) it is possible to optimize coupling of the RF power between an RF source and the bulb.

In one example embodiment, the bottom 625 of the lamp body 600 may consist of a hollow aluminum cylinder with a 5 cm diameter, and a height of 3.8 cm and the top portion 650 have a diameter of 1.6 cm and a height of 1.4 cm. The diameter of the input coupling element 630 is about 0.13 cm and the diameter of the output coupling element 120 is about 0.92 cm. The fundamental resonant frequency of such an air resonator/waveguide is approximately 900 MHz. By adjusting the various design parameters (dimensions of the lamp body, length and diameter of the output coupling element, gap between the output coupling element and the walls of the lamp body) as well as other parameters it is possible to achieve different resonant frequencies. Also it is possible by adjusting various design parameters to have numerous other design possibilities for a 900 MHz resonator. Based on the above example design one can see that the diameter of this air resonator/waveguide C (5 cm) is significantly smaller than air resonator A (16.5 cm) in prior art shown in FIG. 11. The compact air resonator/waveguide disclosed has significant advantages over conventional large air resonators and dielectric resonators. The smaller resonator size and exposed arc allows easy integration into existing luminaires. It does not require the use of expensive dielectric materials that will result in RF losses and difficulty in manufacturing. Another significant advantage of the invention is that the input coupling element 630 and the output coupling element 120 are respectively grounded at planes 631 and 605, which are coincident with the outer surface of the lamp body 600. This eliminates the need to fine-tune their depth of insertion into the lamp body—as well as any sensitivity of the RF coupling between them to that depth—simplifying lamp manufacture, as well as improving consistency in lamp brightness yield. This illustration is merely an example, which should not unduly limit the scope of the claims herein. One of ordinary skill in the art would recognize other variations, modifications, and alternatives.

Figure 14:
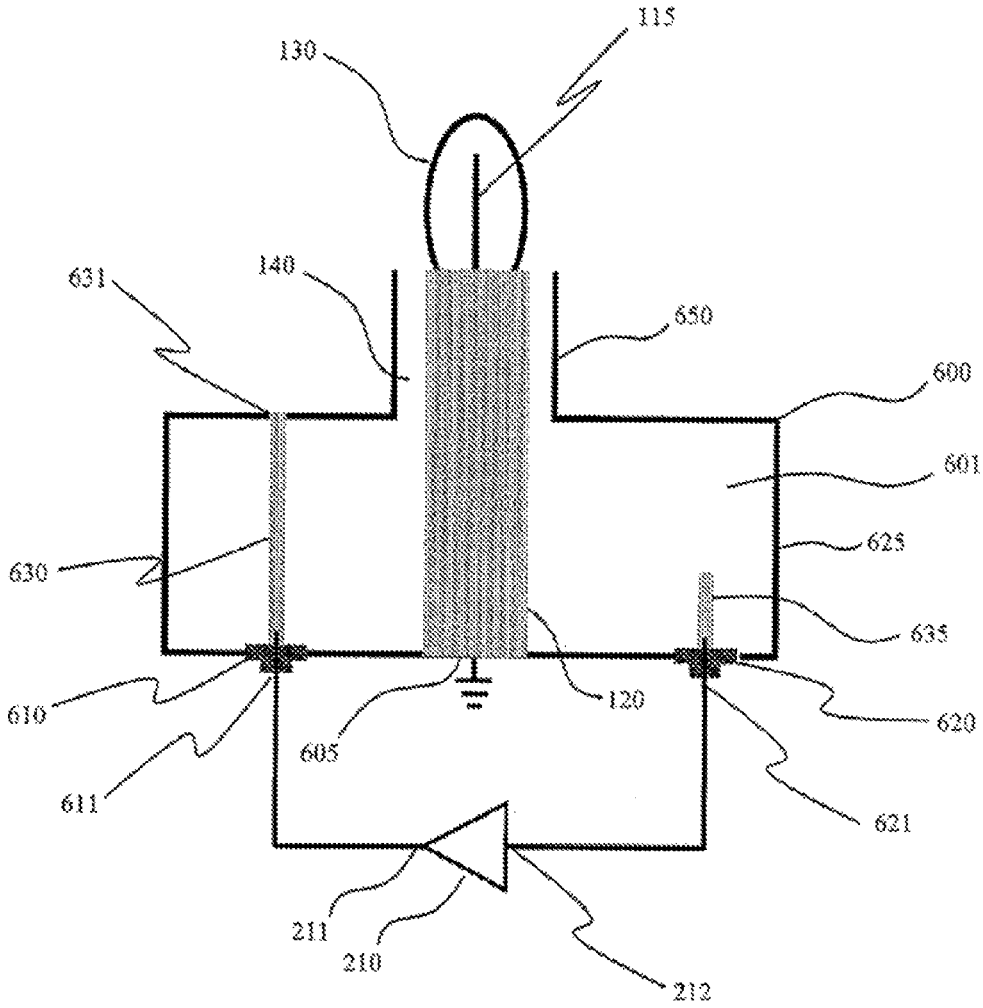
FIG. 14 illustrates a simplified diagram of the lamp in FIG. 13 with an amplifier connected between the feedback coupling element and the input coupling element providing for frequency selective oscillation in the feedback loop according to an embodiment of the present invention.

FIG. 14 illustrates the lamp shown in FIG. 13 with an RF amplifier 210 connected between the feedback coupling element 635 and the input coupling element 630. This diagram is merely example, which should not unduly limit the scope of the claims herein. One of ordinary skill in the art would recognize other variations, alternatives, and modifications. The shorter feedback coupling element 635 couples a small amount of RF energy from the resonator and provides feedback to the RF amplifier input 212 through an RF connector 621. The feedback coupling element 635 is closely received by the lamp body 600 through opening 620 and as such is not in direct DC electrical contact with the conductive surface of the lamp body. The input coupling element 630 is conductively connected with RF amplifier output 211 through RF connector 611. Input coupling element 630 is closely received by the lamp body 600 through the opening 610 and as such is not in direct electrical contact with the lamp body at the bottom surface. However, the other end of the input coupling element is connected to the lamp body 600 at 631. The feedback loop between the feedback coupling element, the RF amplifier, the input coupling element, and the air resonator/waveguide results in oscillation as long as the amplifier has gain at the resonant frequency of the resonator that is larger than the feedback loop losses and the phase of the feedback loop satisfies steady state oscillation conditions. The RF power from the amplifier is coupled to the output coupling element 120 by the input coupling element. The output coupling element couples the RF energy to the bulb resulting in ionization of the inert gas followed by vaporization of the light emitter which then results in light emission from the bulb. Of course, there can be other variations, modifications, and alternatives.

Figure 15A:
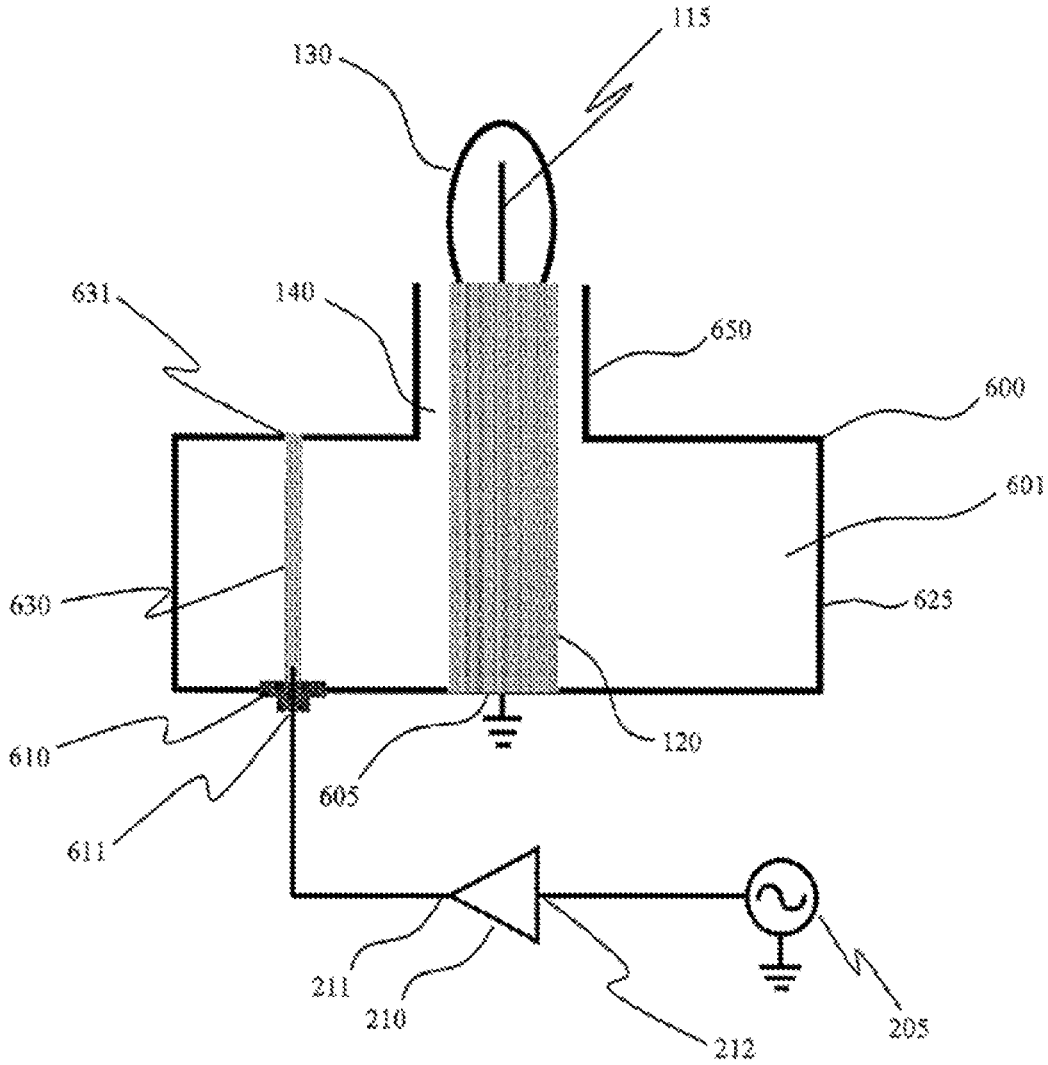
FIG. 15A illustrates a simplified diagram of the lamp in FIG. 13 without the feedback coupling element. An RF source that may comprise an oscillator and an amplifier is connected to the input coupling element according to an embodiment of the present invention.

FIG. 15A illustrates a lamp similar to FIG. 14 except that the feedback coupling element has been eliminated. This diagram is merely example, which should not unduly limit the scope of the claims herein. One of ordinary skill in the art would recognize other variations, alternatives, and modifications. Instead the RF source is provided by an oscillator 205 and an RF amplifier 210 with the output of the oscillator connected to the input 212 of the RF amplifier 210 and the output of the amplifier 211 is conductively connected with the input coupling element 630 through an RF connector 611. The input coupling element delivers RF power to the output coupling element 120 which then couples it to the gas filled vessel 130. This illustration is merely an example, which should not unduly limit the scope of the claims herein. One of ordinary skill in the art would recognize other variations, modifications, and alternatives.

Figure 15B:
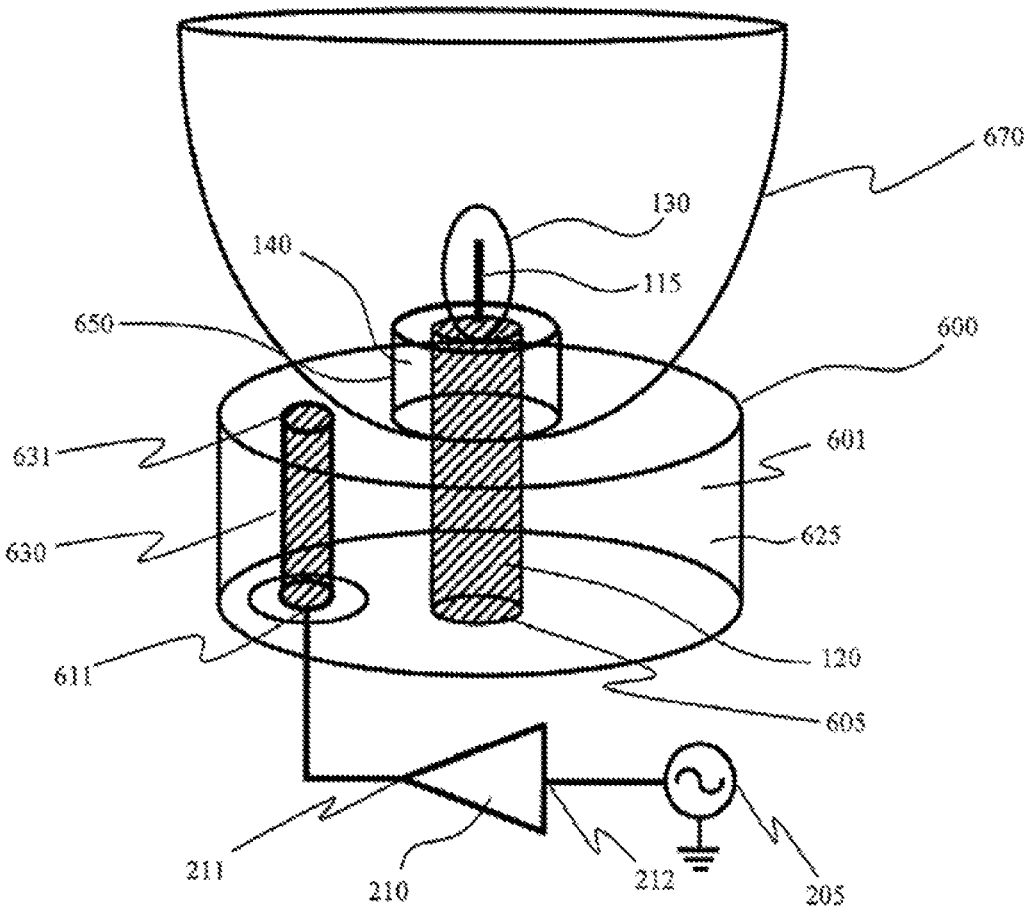
FIG. 15B is a simplified perspective view of the lamp in FIG. 15A showing the input coupling element, the integrated bulb/output coupling element assembly consisting of the output coupling element and a gas filled vessel (bulb), and a reflector according to an embodiment of the present invention.

FIG. 15B is a perspective view of the lamp shown in FIG. 15A with an added reflector 670. The luminous output from the bulb 130 is collected and directed by an external reflector 670, which is either electrically conductive or if it is made from a dielectric material has an electrically conductive backing, and which is attached to and in electrical contact with the lamp body 600. Reflector 670 is depicted as parabolic in shape with bulb 130 positioned near its focus. Those of ordinary skill in the art will recognize that a wide variety of possible reflector shapes can be designed to satisfy beam direction and distribution requirements. In a specific embodiment, the shapes can be conical, convex, concave, trapezoidal, pyramidal, or any combination of these, and the like. This illustration is merely an example, which should not unduly limit the scope of the claims herein. One of ordinary skill in the art would recognize other variations, modifications, and alternatives.

Figure 16B:
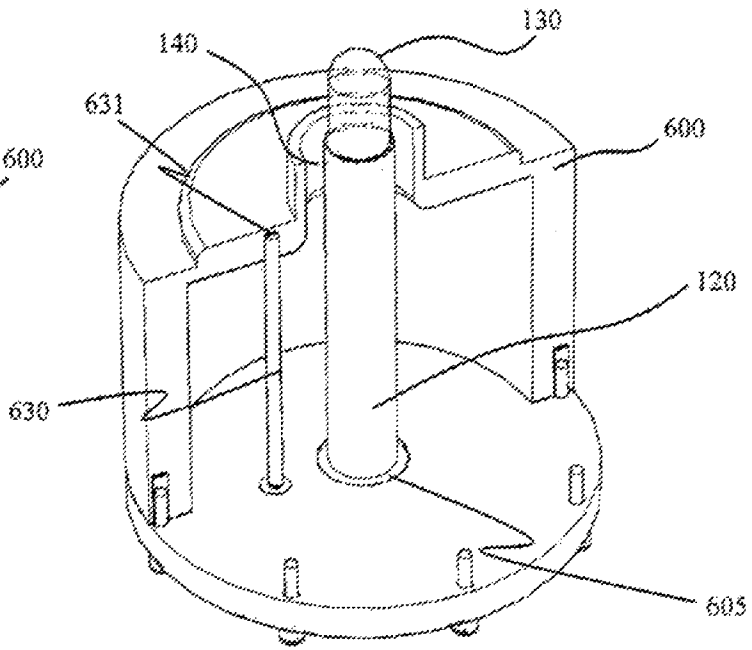
FIG. 16B shows a simplified diagram of the cross-sectional perspective view in FIG. 16A with the integrated bulb/output coupling element screwed into the bottom of the conductive lamp body according to an embodiment of the present invention.
Figure 16A:
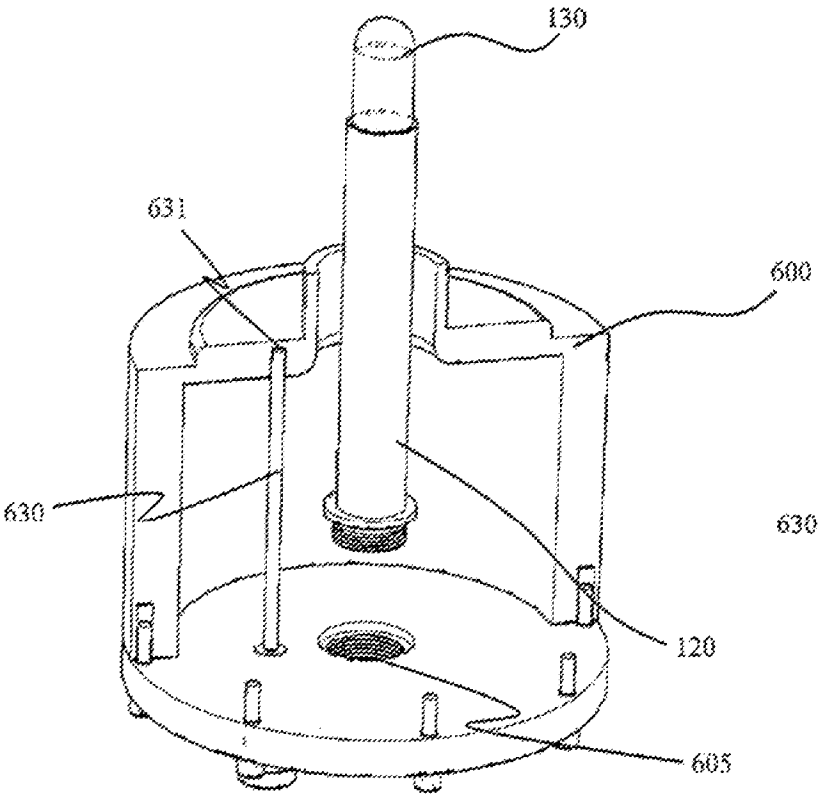
FIG. 16A is a simplified cross-sectional perspective view of the lamp in FIG. 15B without the RF source and the reflector according to an embodiment of the present invention.

FIG. 16A is a cross-sectional perspective view of the lamp in FIG. 15B without the RF source and the reflector. The input coupling element 630 is shown connected to the top surface 631 of the conductive lamp body of the compact air resonator/waveguide 600. In this embodiment the integrated bulb/output coupling element assembly 120 is shown (unassembled) with a tapped screw bottom that can screw into the bottom of the conductive lamp body 605. In this case the output coupling element is made from a solid conductor but it is possible to make it from a dielectric material with an electrically conductive layer. Since there are no electric fields inside the dielectric material the RF losses of the dielectric support structure used is not important. Other attachment methods, such as using set screws, are possible for connecting the output coupling element to the lamp body. This illustration is merely an example, which should not unduly limit the scope of the claims herein. One of ordinary skill in the art would recognize other variations, modifications, and alternatives.

FIG. 16B is similar to FIG. 16A but in this case the output coupling element 120 is screwed into the bottom of the conductive lamp body 605. This diagram is merely example, which should not unduly limit the scope of the claims herein. One of ordinary skill in the art would recognize other variations, alternatives, and modifications. The gap 140 between the output coupling element 120 and the lamp body 650 as well as the length and the diameter of the output coupling element 120 are important in determining the resonant frequency of the air resonator/waveguide.

Figure 17A:
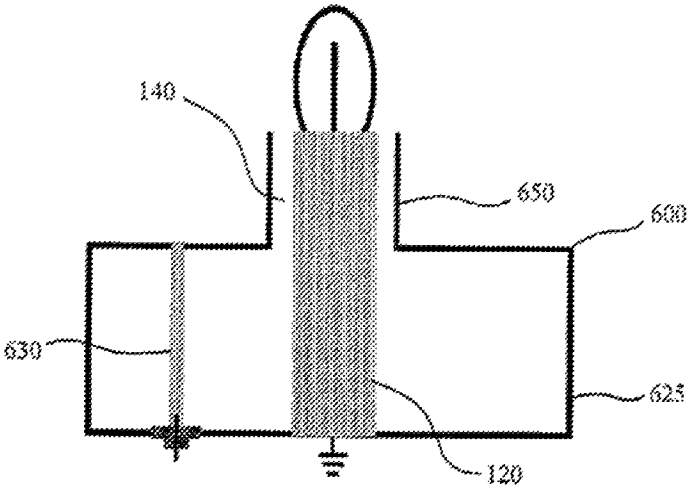
FIGS. 17A, 17B, 17C, and 17D illustrate simplified diagrams of some alternative variations in the design of the compact air resonator/waveguide to achieve the same resonant frequency according to embodiments of the present invention.
Figure 17B:
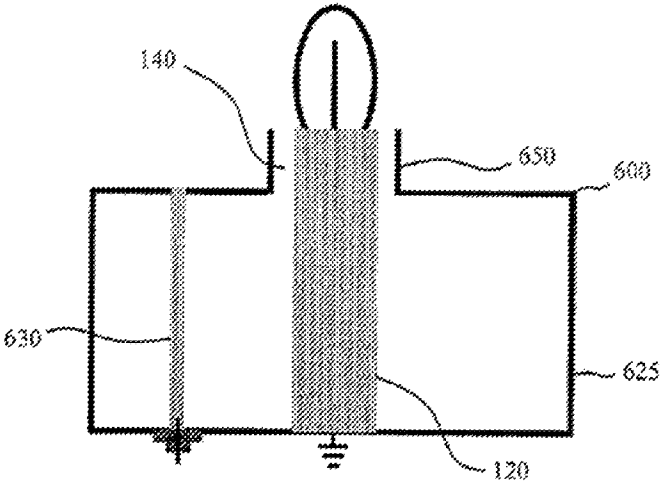
Figure 17C:
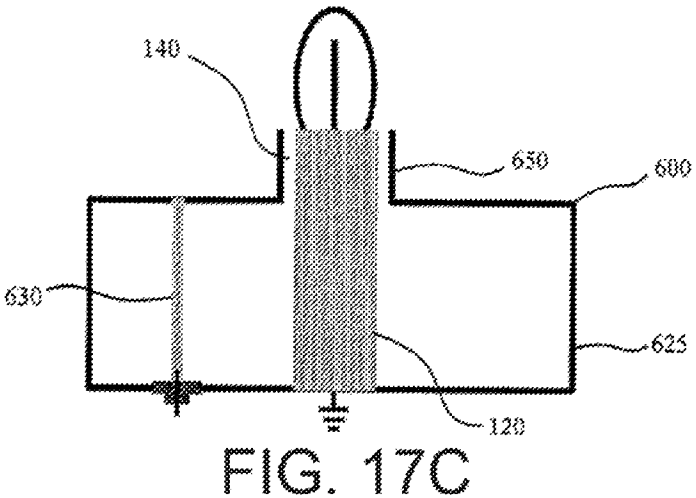
Figure 17D:
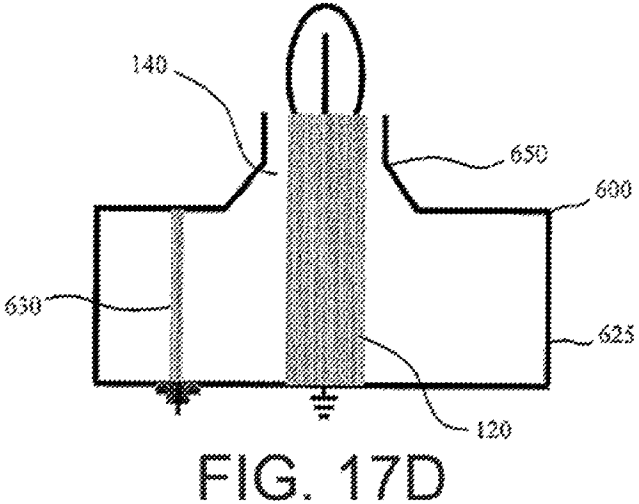

FIGS. 17A, 17B, 17C, and 17D illustrate some possible variations in the design of the compact air resonator/ waveguide to achieve the same resonant frequency. Numerous other variations are possible giving the designer flexibility in the design of the compact air resonator/waveguide. By adjusting the length of the output coupling element 120, the length of the top section of the lamp body 650 versus the size of the bottom section 625 as shown in FIG. 17B it is possible to achieve the same resonant frequency as the air resonator/waveguide shown in FIG. 17A. Another possibility is to change the air gap 140 between the top section 650 and the output coupling element 120 as shown in FIG. 17C but use a shorter top section 650 to achieve the same resonant frequency. In FIG. 17D part of the top section 650 of the air resonator is tapered to allow more gradual transition from the bottom section 625 to the top section. Many other variations are possible including changing the diameter of the output coupling element 120 or changing the dimensions of the bottom section 625 to change the resonant frequency of the air resonator/waveguide. These illustrations are merely some examples, which should not unduly limit the scope of the claims herein. One of ordinary skill in the art would recognize other variations, modifications, and alternatives.

Figure 18:
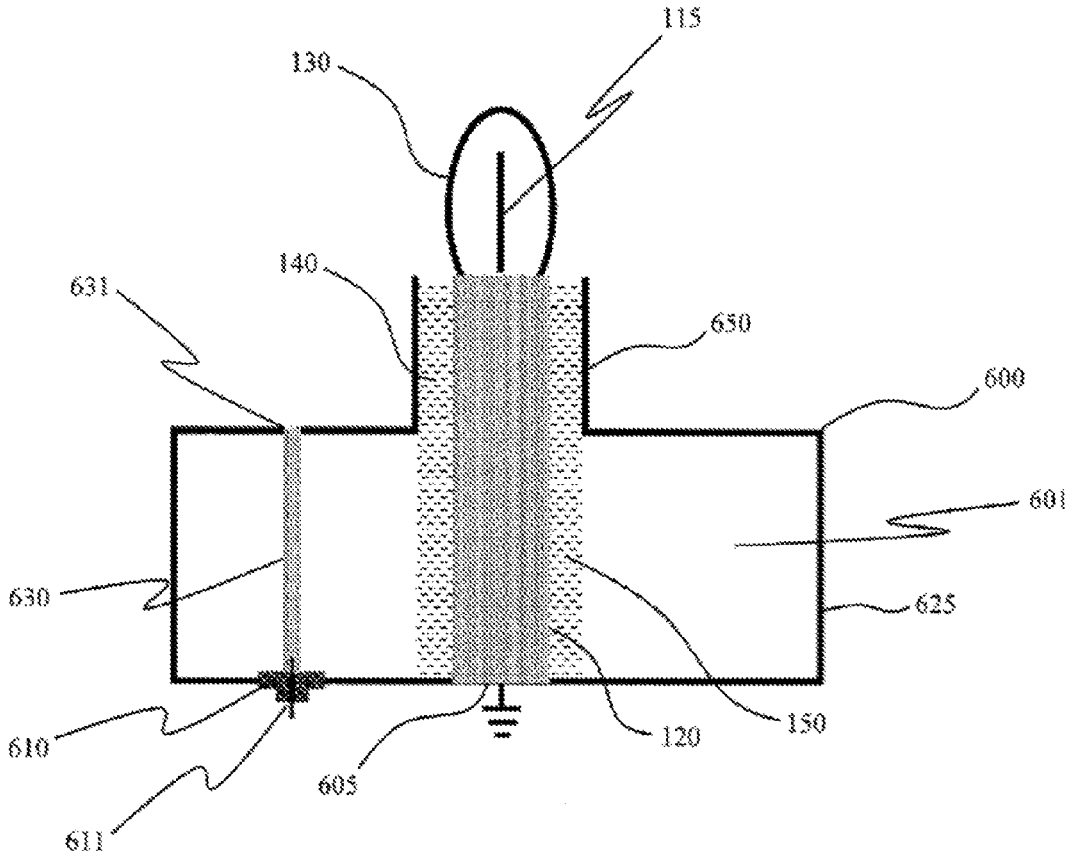
FIG. 18 shows a simplified diagram of another embodiment of the present invention in which a dielectric sleeve is inserted around the output coupling element.

FIG. 18 shows another embodiment of the present invention in which a dielectric sleeve 150 is inserted around the output coupling element 120. This diagram is merely example, which should not unduly limit the scope of the claims herein. One of ordinary skill in the art would recognize other variations, alternatives, and modifications. The dielectric sleeve increases the capacitance in the gap 140 between the output coupling element 120 and the top section of the lamp body 650 resulting in lowering the resonant frequency of the resonator/waveguide. The dielectric sleeve can be made from a material such as quartz but other materials are possible. One of ordinary skill in the art would recognize other variations, modifications, and alternatives.

Figure 19:
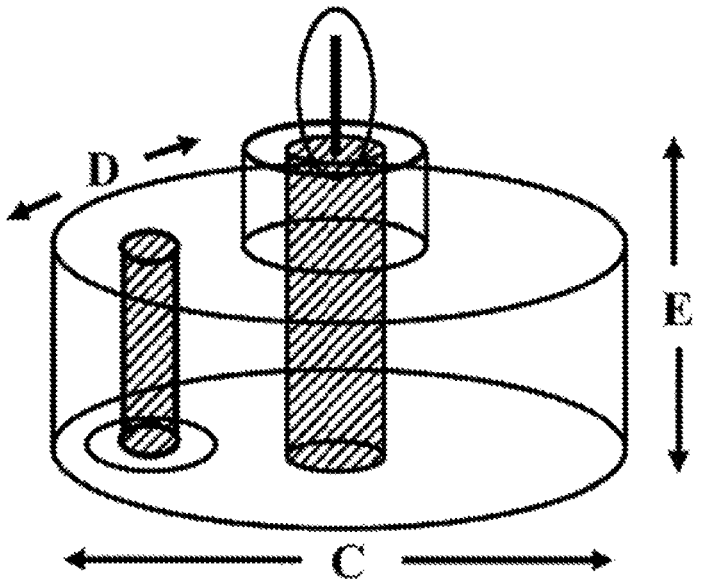
FIG. 19 is similar to FIG. 15B showing an embodiment of the compact air resonator/waveguide without the reflector and the RF source. The maximum dimensions of the compact air resonator/waveguide are less than ½ of the free space wavelength of the resonant frequency of the fundamental mode of the air resonator/waveguide.

FIG. 19 is similar to FIG. 15B showing an embodiment of the compact air resonator/waveguide without the reflector and the RF source. This diagram is merely example, which should not unduly limit the scope of the claims herein. One of ordinary skill in the art would recognize other variations, alternatives, and modifications. The maximum dimension (dimensions C, D, and E in the Figure) of the compact air resonator/waveguide of any one dimension in a three coordinate system (XYZ) is less than ½ of the free space wavelength of the resonant frequency of the fundamental mode of the air resonator/waveguide. As shown in a specific embodiment, the present invention provides a plasma lamp apparatus. The apparatus includes a gas filled vessel having a transparent or translucent body configured by an inner region and an outer surface region, a cavity being defined within the inner region. The apparatus also has an air resonator region configured within a vicinity of the gas filled vessel. In a specific embodiment, the air resonator region has a maximum dimension of less than ½ of a free space wavelength of a fundamental resonant frequency of the air resonator region. The apparatus has an rf source configured to generate a resonant frequency of 2.5 GHz and less and coupled to the air resonator region. Of course, there can be other variations, modifications, and alternatives.

In alternative specific embodiments as shown, the present invention provides an alternative plasma lamp apparatus. The apparatus has a waveguide body having a maximum dimension of less than ½ of a free space wavelength of a resonant frequency. The maximum dimension is selected from any one dimension in a three coordinate system. Of course, there can be other variations, modifications, and alternatives.

Figure 20:
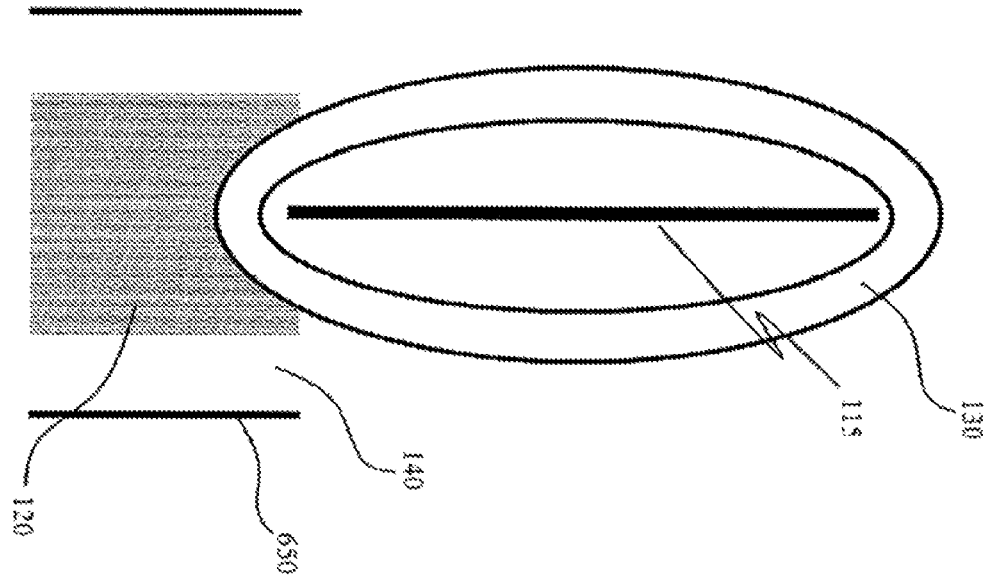
FIG. 20 shows a simplified diagram of the temperature profile of the surface of the gas filled vessel (in this case a quartz bulb) as a function of the distance above the output coupling element. In this case the bulb is operated in the vertical direction.
Figure 20:
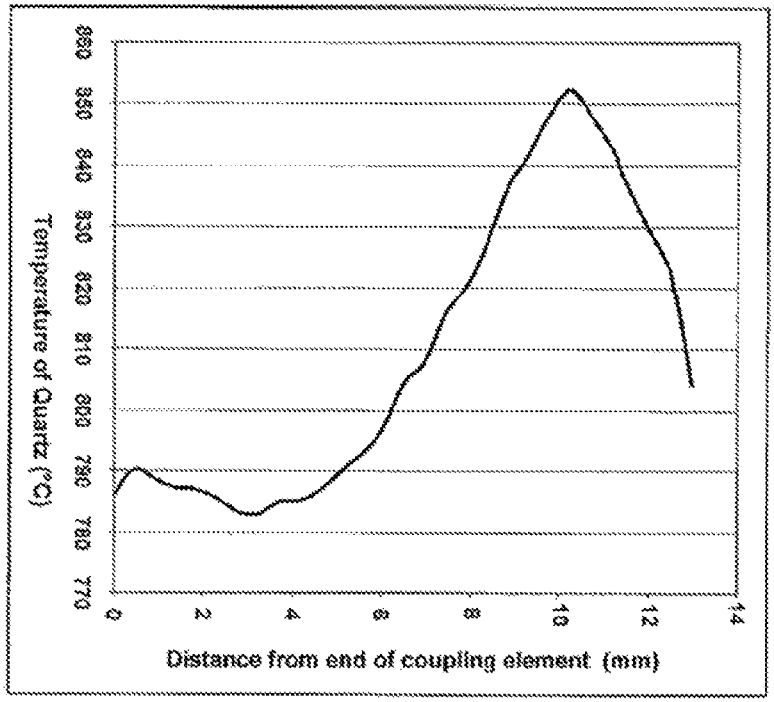

FIG. 20 shows the temperature profile of the surface of the gas filled vessel (in this case a quartz bulb) as a function of the distance above the output coupling element. The bulb as well as part of the top portion of the resonator/waveguide from FIG. 13 is shown on the right hand side of FIG. 20. This diagram is merely example, which should not unduly limit the scope of the claims herein. One of ordinary skill in the art would recognize other variations, alternatives, and modifications. In this case the bulb is operated in the vertical direction. The maximum temperature of around 852° C. occurs approximately at ⅔ of the length of the bulb above the end of the output coupling element. The lowest temperature of around 783° C. occurs just slightly above the end of the output coupling element which in this case is also in close proximity to the maximum Electric field region inside the bulb. Depending on the orientation of the bulb, design of the resonator (including dimensions of the output coupling element and materials used to make it) as well as the shape and size of the bulb, as well as other parameters, one can change the temperature profile of the surface of the bulb. Of course, there can be other variations, modifications, and alternatives.

In still an alternative embodiment as shown, the present invention provides still an alternative plasma lamp apparatus. The apparatus has a gas filled vessel having a transparent or translucent body configured by an inner region and an outer surface region and a cavity being defined within the inner region. In a specific embodiment, the gas filled vessel has a first end portion and a second end portion. The apparatus has a maximum temperature profile spatially disposed within a center region of the gas filled vessel in a preferred embodiment, although the maximum may be slightly offset in some cases. In a specific embodiment, the center region is between the first end portion and the second end portion. In a preferred embodiment, the maximum temperature profile is within a vicinity of the outer surface region substantially free from interference with a solid resonator body region. Of course, there can be other variations, modifications, and alternatives.

Figure 21A:
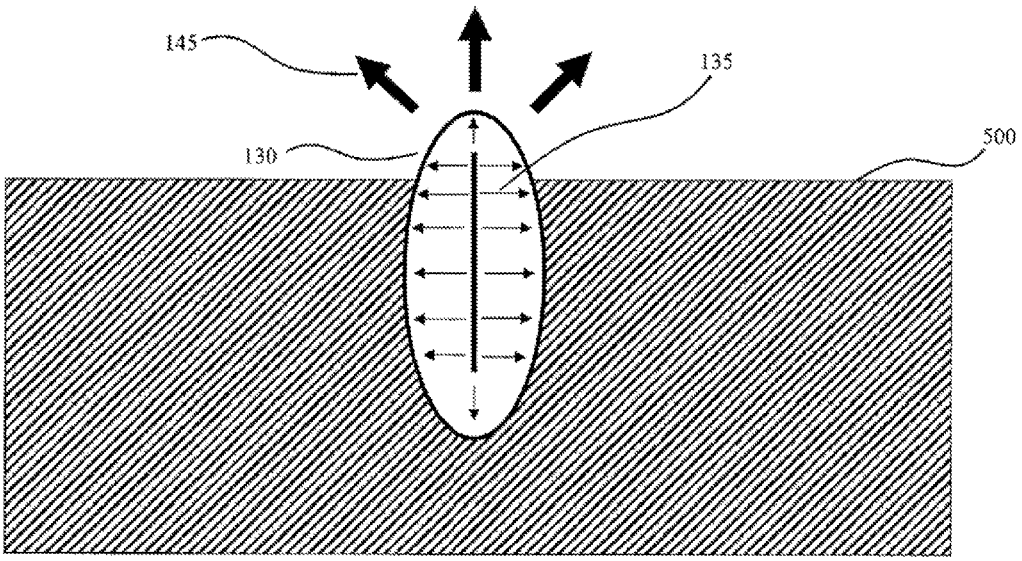
FIG. 21A shows a simplified cross sectional view of a gas filled vessel in a conventional dielectric resonator showing that the majority of the light from the arc gets reflected back into the bulb before eventually exiting the top surface of the bulb.
Figure 21B:
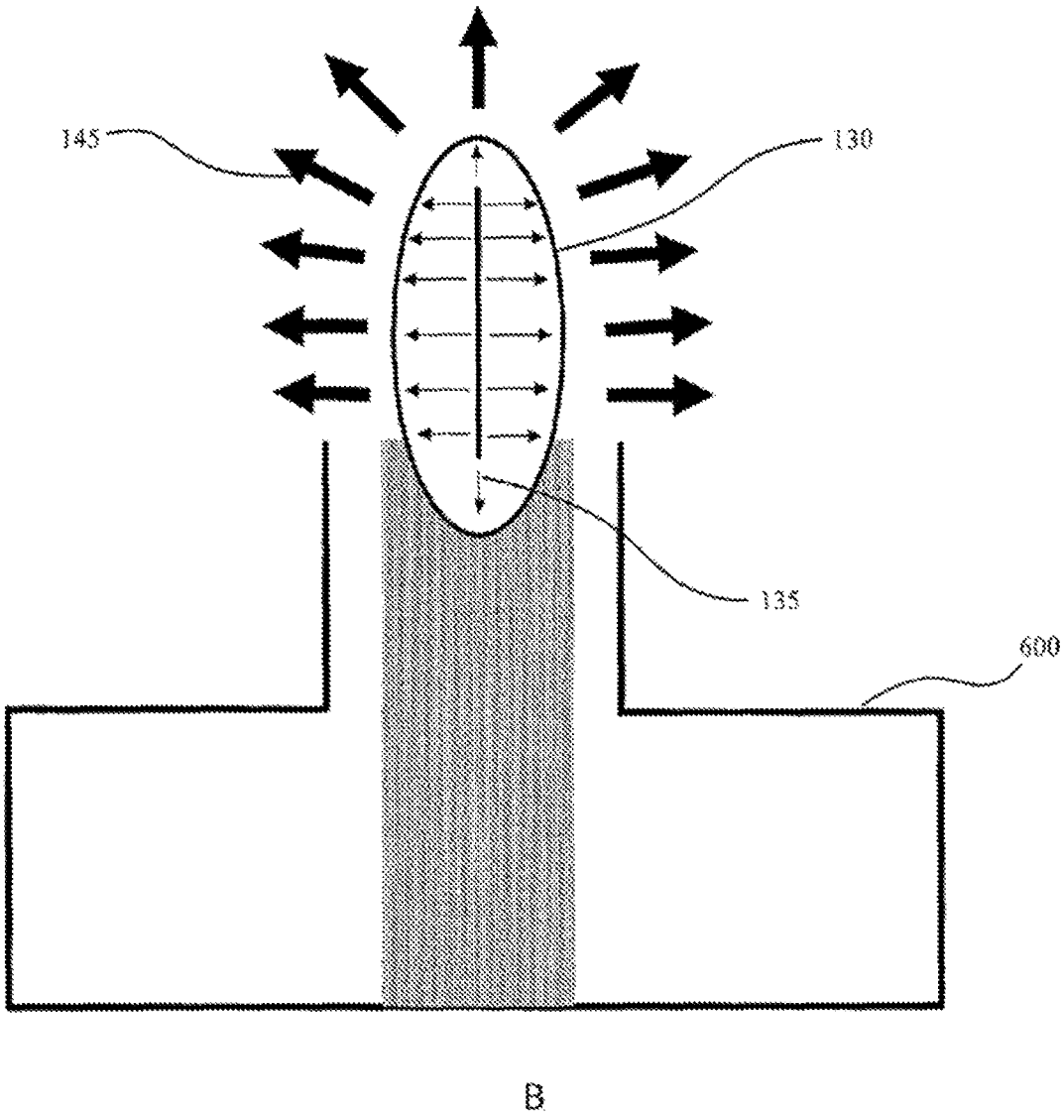
FIG. 21B shows a simplified cross sectional view of a gas filled vessel in one of the embodiments of this invention showing that the majority of the light from the arc in this case does not get reflected back into the bulb before exiting the surface of the bulb.

FIG. 21A shows a simplified cross sectional view of a gas filled vessel 130 in a conventional dielectric resonator 500 and FIG. 21B shows a simplified cross sectional view of a gas filled vessel 130 in an embodiment 600 of the present invention. This diagram is merely example, which should not unduly limit the scope of the claims herein. One of ordinary skill in the art would recognize other variations, alternatives, and modifications. As one can see in FIG. 21A in the case of the conventional dielectric resonator the majority of the light from the arc of the bulb (135) will first hit the opaque walls of the dielectric resonator since most of the bulb is inside the dielectric resonator and the light gets reflected back into the bulb. Part of this reflected light gets absorbed by the arc and then re-emitted. The light continues to bounce back and forth until it is emitted (145) from the top surface of the bulb. Typically a reflective coating or material is used to surround the bulb (except for the top surface) to reduce reflective losses but nevertheless some of the reflected light is lost in the process. In the case of the compact air resonator/waveguide 600 shown in FIG. 21B the majority of the emitted light 135 from the arc of the bulb pass through the walls of the transparent or translucent gas filled vessel without being reflected back into the bulb. The light emitted from the surface of the bulb 145 is emitted from most of the surface of the bulb without having gone through multiple reflections. Of course, there can be other variations, modifications, and alternatives.

As shown, the present invention provides a plasma lamp apparatus according to one or more embodiments. The apparatus comprises a gas filled vessel having a transparent or translucent body configured by an inner region and an outer surface region, a cavity being defined within the inner region and an rf source coupled to the gas filled vessel to cause electromagnetic radiation to pass through at least 50% of the outer surface region without reflection back into the inner region of the gas filled vessel. Moreover, the present invention provides a method for emitting electromagnetic radiation from a plasma lamp apparatus. The method includes generating electromagnetic radiation from within an inner region of a gas filled vessel using at least one or more rf sources configured to provide rf energy to the gas filled vessel and transmitting a portion of the electromagnetic radiation from the inner region of the gas filled vessel through at least 50% of an outer surface region of the gas filled vessel without substantial refection back into the inner region of the gas filled vessel. Of course, there can be other variations, modifications, and alternatives.

Figure 22B:
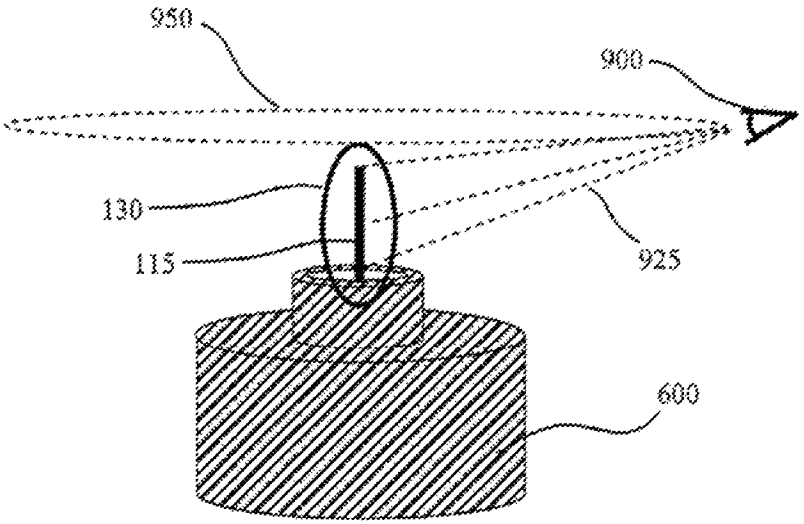
FIG. 22B shows a simplified diagram of a perspective view of one of the embodiments of this invention demonstrating that from the perspective of a viewer the majority of the arc is visible including as the viewer moves 360 degrees around the air resonator/waveguide.
Figure 22A:
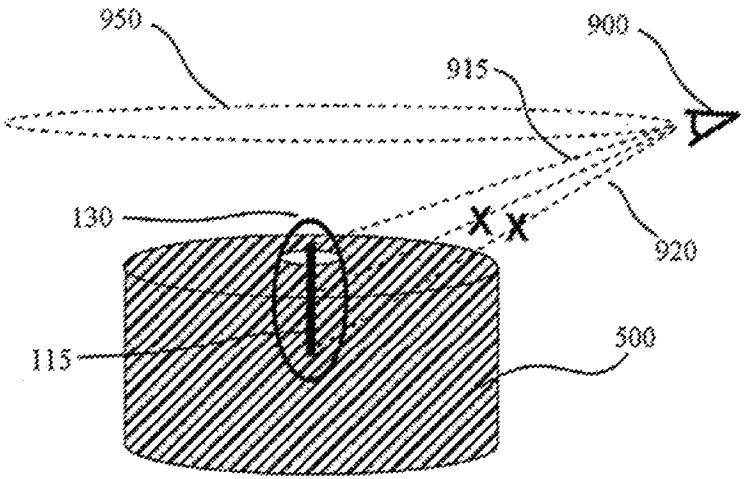
FIG. 22A shows a simplified diagram of a perspective view of a conventional dielectric resonator demonstrating that from the perspective of a viewer only the top portion of the arc is visible and the view to the majority of the arc is blocked by the opaque dielectric resonator.

FIG. 22A shows a perspective view of a conventional dielectric resonator 500 and FIG. 22B shows a perspective view of an embodiment of the present apparatus 600 according to an embodiment of the present invention. From the perspective of a viewer 900 in FIG. 22A looking at the arc of the bulb 115 only the top portion of the arc is visible (top dashed line of sight 915). The other two line of sights (two dashed lines marked with an X 920) to the middle and bottom of the arc are blocked by the opaque dielectric resonator. If the viewer moves around 360 degrees in a circle around the dielectric resonator (circular dashed line 950) still only the top of the arc is visible to the observer. In the case of the compact air resonator/waveguide 600 shown in FIG. 22B a viewer 900 has a clear line of sight to the bottom, middle, and top of the arc of the bulb 115 (three dashed lines 925). In addition if the viewer moves around 360 degrees in a circle around the compact air resonator (circular dashed line 950), the viewer will have a clear view of the arc of the bulb. Of course, there can be other variations, modifications, and alternatives.

The present invention provides an electrode-less plasma lamp apparatus in yet an alternative embodiment as shown. The apparatus has a gas filled vessel having transparent or translucent body configured by an inner region and an outer surface region, a cavity being defined within the inner region, which is free from one or more electrode structures. The apparatus has a support body configured to mate with the gas filled vessel and an arc feature caused by electromagnetic radiation and having a first end and a second end provided spatially within the inner region. In a preferred embodiment, at least 50% of the arc feature is exposed when viewed from any spatial position within 360 Degrees and greater of an imaginary line normal to a center portion between the first end and the second end of the arc feature. In one or more embodiments, the arc feature is provided within the spatial region between a first end and a second end of the inner region. Of course, there can be other variations, modifications, and alternatives.

In yet other embodiments, the present invention provides an electrode-less plasma lamp apparatus. The apparatus has a gas filled vessel having transparent or translucent body configured by an inner region and an outer surface region and a cavity being defined within the inner region, which is free from one or more electrode structures. The apparatus also has a maximum electric field region configured within a portion of the inner region of the gas filled vessel. In a specific embodiment, the maximum electric field region is exposed from an exterior region of the gas filled vessel when viewed from any spatial position within 360 Degrees and greater of an imaginary line normal to a center portion of the gas filled vessel.

Figure 23B:
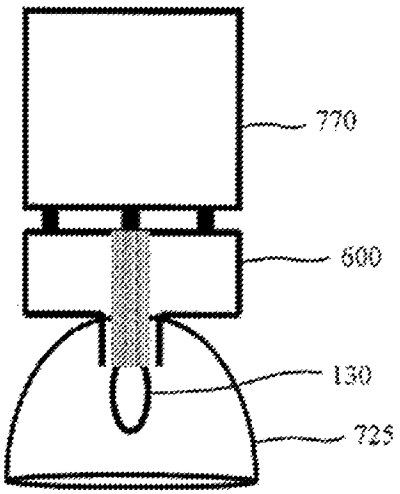
FIG. 23B shows a simplified diagram of a luminaire using one of the embodiments of this invention using a very compact gas filled vessel which is acting as a point light source.
Figure 23A:
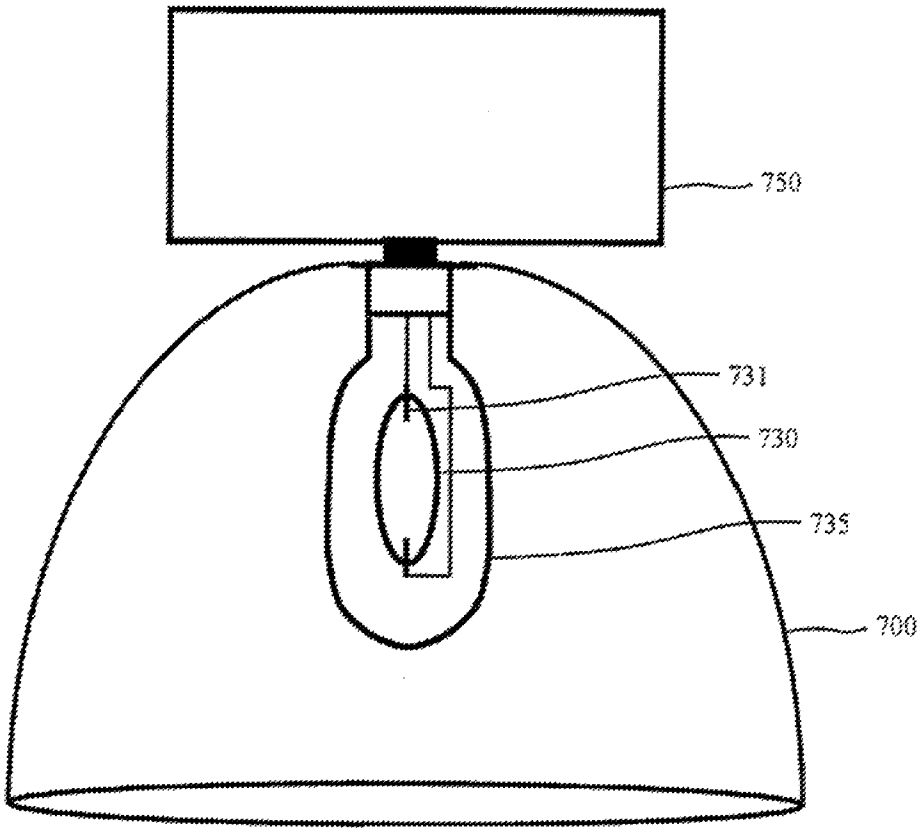
FIG. 23A shows a simplified diagram of a luminaire using a conventional metal halide lamp with electrodes inside the bulb.

FIG. 23A shows a luminaire using a metal halide lamp 730 with electrodes inside the bulb 731. A secondary glass/quartz envelope 735 surrounds the gas filled vessel 731. A ballast 750 is used to operate the lamp. In this case since the arc of the bulb is large it is difficult to design compact low-cost reflector 700 that can efficiently collect all the light that the bulb generates. In the case of a luminaire designed using one of the embodiments of this invention, FIG. 23B, the gas filled vessel (bulb) 130 is compact so it can be treated as a point light source in designing reflectors. As a result from compact and efficient reflectors 725 can be designed to collect all the light that the bulb generates. In this case an RF driver/ballast 770 is used to operate the lamp. In one or more embodiments, the invention preferably provides a single source plasma lamp apparatus. The apparatus has a single point source configured to be electrode-less and having a maximum dimension of 3 centimeters and less and an emission of electromagnetic radiation having at least 20,000 lumens emitted from the single point source. As shown, the present apparatus eliminates the use of arrays of lamps and other complex cumbersome designs. This diagram is merely example, which should not unduly limit the scope of the claims herein. One of ordinary skill in the art would recognize other variations, alternatives, and modifications.

Figure 24:
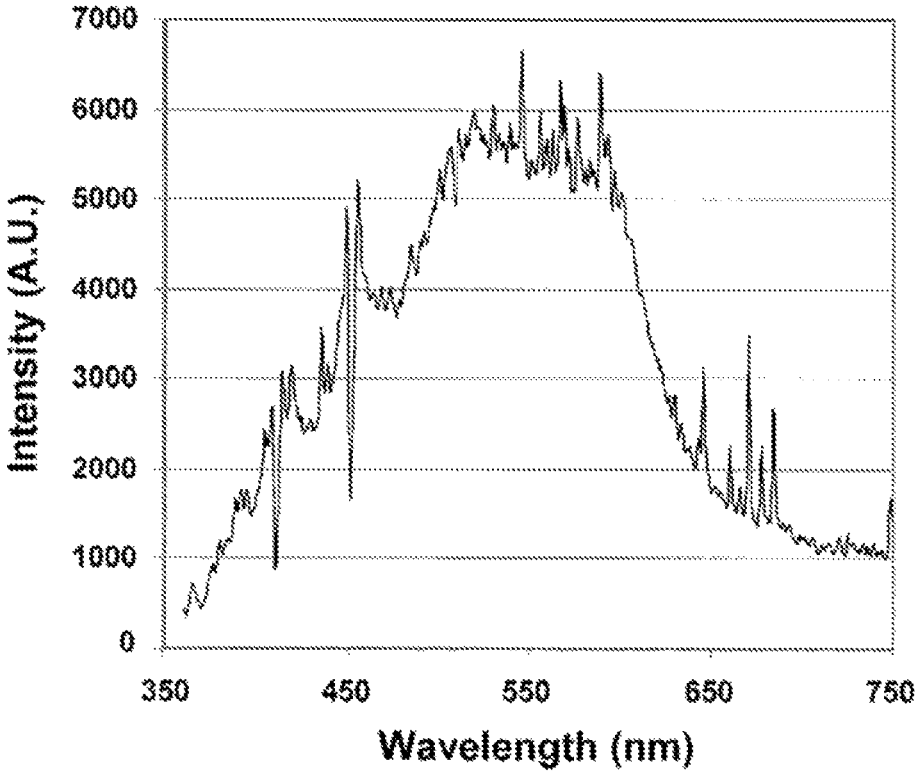
FIG. 24 shows a simplified diagram of an example of the spectrum emitted from one of the embodiments of this invention. The spectrum has emission in the visible, ultraviolet, and infrared region of the spectrum.

FIG. 24 shows an example of the spectrum emitted from one of the embodiments of this invention. This diagram is merely example, which should not unduly limit the scope of the claims herein. One of ordinary skill in the art would recognize other variations, alternatives, and modifications. The spectrum has emission in the visible, ultraviolet, and infrared region of the spectrum. By changing the light emitters inside the gas filled vessel one can change the spectral characteristics of the emitted light. The device is also provided in one or more embodiments. The device comprises an rf source; an electromagnetic resonator structure coupled to at least one rf coupling element configured to introduce rf energy into the electromagnetic resonator structure and a bulb comprising a fill material. The bulb is coupled to the electromagnetic resonator structure to emit electro-magnetic energy from a spectrum of at least ultra-violet, visible, or infrared; and an exposed region of the bulb protruding outside of the electromagnetic resonator structure to cause a substantial portion of the electromagnetic radiation to be emitted from exterior surfaces of the bulb without reflection from the electromagnetic resonator structure. In one or more embodiments, the spectrum may include combinations of the above as well as other regions. Of course, there can be various combinations, alternatives, and variations.

While the above is a full description of the specific embodiments, various modifications, alternative constructions and equivalents may be used. Therefore, the above description and illustrations should not be taken as limiting the scope of the present invention which is defined by the appended claims.

What is claimed is:

1. A plasma lamp apparatus comprising:

a housing having an interior region and an exterior region, the interior region configured with a hollow spatial volume forming an air resonator;

a support member provided within an interior region of the housing, the support member having at least a conductive exterior region, the support member having a first end and a second end;

an RF source coupled to the support member;

a bulb coupled to at least the first end of the support member, the bulb having an internal volume ranging from about 0.2 cubic centimeters to about 0.5 cubic centimeters;

a first coupling member disposed within the spatial volume of the housing;

a gap provided between the first coupling member and the support member; and a fill material comprising argon gas, thulium bromide, indium bromide, and mercury, the fill material being disposed within the bulb.

2. The device of claim 1 further comprising krypton-85 radioactive gas ranging from about 3 nanoCuries/cm3 to about 400 nanoCuries/cm3.

3. The device of claim 1 wherein the fill material is configured to discharge a substantially white light; wherein the argon gas is provided at a pressure ranging from about 50 torr to about 600 torr.

4. The device of claim 3 wherein the substantially white light is discharged providing at least 120 lumens per watt.

5. The device of claim 1 further comprising dysprosium bromide provided at a concentration ranging from about zero to about seventeen mg/cm3 and holmium bromide provided at a concentration ranging from about zero to about seventeen mg/cm3.

6. The device of claim 1 further comprising dysprosium bromide and holmium bromide at a determined amount to cause a substantially white light discharge along a visible range representative of a black body source at a selected color temperature.

7. The device of claim 5 wherein the selected color temperature ranges from about 3500 to about 5000 degrees Kelvin (K).

8. The device of claim 1 wherein the argon gas is provided at a pressure ranging from about 50 torr to about 600 torr.

9. The device of claim 1 wherein the thulium bromide is provided at a concentration ranging from about two to about seventeen mg/cm3.

10. The device of claim 1 wherein the indium bromide is provided at a concentration ranging from about two to about seventeen mg/cm3.

11. The device of claim 1 wherein the mercury is provided at a concentration ranging from about eight to about twelve mg/cm3.

12. The device of claim 1 wherein the fill material is maintained at a temperature ranging from about 700 degrees Celsius (.degree. C.) to about 1000.degree. C.

13. The device of claim 1 wherein the housing comprises a metal material.

14. The device of claim 1 wherein the support member comprises a substantially metal material.

15. The device of claim 1 wherein the support member comprises an aluminum material.

16. The device of claim 1 further comprising a luminous flux of at least 20000 lumens.

17. The device of claim 1 wherein the bulb comprises a quartz, translucent alumina, or substantially transparent material.

18. A plasma lamp apparatus comprising:

a housing having an interior region and an exterior region, the interior region configured with a hollow spatial volume forming an air resonator;

a support member provided within an interior region of the housing, the support member having at least a conductive exterior region, the support member having a first end and a second end;

an RF source coupled to the support member;

a bulb coupled to at least the first end of the support member, the bulb being configured to extend outside the housing such that an arc of the bulb is not surrounded by walls of the resonator, the bulb having an internal volume ranging from about 0.2 cubic centimeters to about 0.5 cubic centimeters;

first coupling member disposed within the spatial volume of the housing;

a gap provided between the first coupling member and the support member; and a fill material spatially disposed within the bulb, the fill material having at least a first volume of a rare gas, a first amount of a first metal halide, a second amount of a second metal halide, and a third amount of mercury.

19. The apparatus of claim 18 wherein the first metal halide comprises indium halide, aluminum halide, or gallium halide.

20. The apparatus of claim 19 wherein the halide is selected from chlorine, indium, or bromine.

21. The apparatus of claim 18 wherein the second metal halide comprises at least one lanthanide element.

22. The apparatus of claim 18 wherein the second metal halide comprises thulium halide, dysprosium halide, holmium halide, cerium halide, or ytterbium halide.

23. The apparatus of claim 22 wherein the halide is selected from chlorine, iodine, or bromine.

24. The apparatus of claim 18 wherein the second metal halide comprises a combination of thulium halide, dysprosium halide, holmium halide, cerium halide, and/or ytterbium halide.

25. The apparatus of claim 24 wherein the halide is selected from chlorine, iodine, or bromine.

26. The apparatus of claim 18 wherein the rare gas comprises argon gas, xenon gas, or krypton gas.

27. The apparatus of claim 18 wherein the rare gas is combined with Krypton 85 gas.

28. The apparatus of claim 18 wherein the first amount of the first metal halide and the second amount of the second metal halide are about two to about seventeen mg/cm3.

29. The apparatus of claim 18 wherein the third amount of mercury is about eight to about twelve mg/cm3.

30. The apparatus of claim 18 wherein the first volume of the rare gas is a determined amount to create an inert environment within the inner region of the bulb.

31. The device of claim 1 wherein the bulb is configured to extend outside the housing such that an arc of the bulb is not surrounded by walls of the resonator.

* * * * *